US007828294B2

(12) United States Patent
Nicely et al.

(10) Patent No.: US 7,828,294 B2
(45) Date of Patent: Nov. 9, 2010

(54) GAMING SYSTEM HAVING A DICE-BASED GAME WITH A PLURALITY OF WAGER AREAS

(75) Inventors: Mark C. Nicely, Daly City, CA (US); Paul D. Miltenberger, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 12/435,077

(22) Filed: May 4, 2009

(65) Prior Publication Data

US 2009/0305779 A1 Dec. 10, 2009

Related U.S. Application Data

(62) Division of application No. 11/064,314, filed on Feb. 23, 2005, now Pat. No. 7,533,885.

(60) Provisional application No. 60/547,643, filed on Feb. 23, 2004.

(51) Int. Cl.
*A63F 9/24* (2006.01)

(52) U.S. Cl. ..... 273/146; 273/274

(58) Field of Classification Search ..... 273/274, 273/292, 146; 463/12, 13, 16, 22
See application file for complete search history.

(56) References Cited

U.S. PATENT DOCUMENTS

| | | | | |
|---|---|---|---|---|
| 1,578,412 A | | 3/1926 | Ewig | |
| 3,560,127 A | * | 2/1971 | Imperato | 273/246 |
| 3,628,259 A | | 12/1971 | Kahn | |
| 3,819,186 A | | 6/1974 | Hinterstocker | |
| 4,077,631 A | | 3/1978 | Tela, Sr. | |
| 4,156,976 A | | 6/1979 | Mikun | |
| 4,181,308 A | * | 1/1980 | Fox et al. | 273/237 |
| 4,198,052 A | | 4/1980 | Gauselmann | |
| 4,247,114 A | * | 1/1981 | Carroll | 273/274 |
| 4,260,159 A | | 4/1981 | Hoffman | |
| 4,337,945 A | | 7/1982 | Levy | |

(Continued)

FOREIGN PATENT DOCUMENTS

AU B-13331/88 9/1988

(Continued)

OTHER PUBLICATIONS

"A Salute to Game Shows," The Price is Right—Pricing Games, printed from schuminweb.com/game-shows/shows/price-is-right/pricing-games.htm on Mar. 16, 2001.

(Continued)

*Primary Examiner*—William M Pierce
(74) *Attorney, Agent, or Firm*—K&L Gates LLP

(57) ABSTRACT

A gaming system and method involving a dice game. The gaming system displays a plurality of wager areas. Each wager area is associated with a wager area value. The gaming system indicates a plurality of different reward ratios associated with the wager areas. One or more of the wager areas are selectable by the player for wagering. A plurality of dice are simulated as rolled. If the sum of the stopped dice is equal to the value of any of the wagered upon areas, the gaming system provides an award. If a bonus condition is satisfied, the gaming system provides a bonus outcome.

18 Claims, 16 Drawing Sheets

U.S. PATENT DOCUMENTS 4,346,900 A * 8/1982 Lamlee ..... 273/274
4,448,419 A 5/1984 Telnaes
4,492,378 A * 1/1985 Williams ..... 273/142 HA
4,535,994 A * 8/1985 Cowan ..... 273/256
4,621,814 A 11/1986 Stepan et al.
4,624,459 A 11/1986 Kaufman
4,669,731 A 6/1987 Clarke
4,695,053 A 9/1987 Vazquez, Jr. et al.
4,732,386 A 3/1988 Rayfiel
4,746,126 A * 5/1988 Angileri ..... 273/249
4,805,907 A 2/1989 Hagiwara
4,836,546 A 6/1989 DiRe et al.
4,838,552 A 6/1989 Hagiwara
4,840,375 A 6/1989 Lawlor et al.
4,869,505 A 9/1989 Manabe
4,880,237 A 11/1989 Kishishita
4,906,005 A 3/1990 Manabe
4,921,249 A * 5/1990 Kropkowski et al. ..... 273/256
4,941,665 A 7/1990 Klamer
4,989,873 A 2/1991 Manabe
4,991,848 A 2/1991 Greenwood et al.
5,011,159 A 4/1991 Fortunato et al.
5,019,973 A 5/1991 Wilcox et al.
5,046,735 A 9/1991 Hamano et al.
5,085,436 A 2/1992 Bennett
5,088,737 A 2/1992 Frank et al.
5,102,134 A 4/1992 Smyth
5,102,135 A 4/1992 Addiechi
5,116,055 A 5/1992 Tracy
5,123,649 A 6/1992 Tiberio
5,131,655 A 7/1992 Ugawa
5,152,529 A 10/1992 Okada
5,167,413 A 12/1992 Fulton
5,184,821 A 2/1993 Korenek
5,197,736 A 3/1993 Backus et al.
5,224,706 A 7/1993 Bridgeman et al.
5,259,616 A 11/1993 Bergmann
5,263,715 A * 11/1993 Matsumoto et al. ..... 463/22
5,265,881 A * 11/1993 Doherty ..... 273/274
5,294,120 A 3/1994 Schultz
5,294,128 A 3/1994 Marquez
5,308,065 A 5/1994 Bridgeman et al.
5,322,293 A * 6/1994 Goyette ..... 273/246
5,332,228 A 7/1994 Schultz
5,342,047 A 8/1994 Heidel et al.
5,344,144 A 9/1994 Canon
5,350,175 A * 9/1994 DiLullo et al. ..... 273/146
5,356,140 A 10/1994 Dabrowski et al.
5,372,366 A * 12/1994 Gohlke ..... 273/274
5,375,830 A 12/1994 Takemoto et al.
5,377,973 A 1/1995 Jones et al.
5,393,057 A 2/1995 Marnell, II
5,393,061 A 2/1995 Manship et al.
5,395,111 A 3/1995 Inoue
5,397,125 A 3/1995 Adams
5,401,023 A 3/1995 Wood
5,405,143 A 4/1995 Takemoto et al.
5,407,200 A 4/1995 Zalabak
5,413,351 A * 5/1995 Franklin ..... 273/274
5,415,404 A 5/1995 Joshi et al.
5,423,539 A 6/1995 Nagao
5,431,408 A 7/1995 Adams
5,437,452 A 8/1995 Graf et al.
5,449,173 A 9/1995 Thomas et al.
5,456,465 A 10/1995 Durham
5,489,101 A 2/1996 Moody
5,509,655 A 4/1996 Ugawa
5,511,781 A 4/1996 Wood et al.
5,531,448 A 7/1996 Moody
5,542,669 A 8/1996 Charron et al.
5,553,851 A 9/1996 Malavazos et al.
5,560,603 A 10/1996 Seelig et al.
5,569,084 A 10/1996 Nicastro et al.
5,570,885 A 11/1996 Ornstein
5,580,055 A 12/1996 Hagiwara
5,584,486 A 12/1996 Franklin
5,584,763 A 12/1996 Kelly et al.
5,584,764 A 12/1996 Inoue
5,593,161 A * 1/1997 Boylan et al. ..... 273/274
5,611,535 A 3/1997 Tiberio
5,630,585 A 5/1997 Takemoto et al.
5,636,837 A 6/1997 Takemoto et al.
5,636,838 A 6/1997 Caro
5,639,089 A 6/1997 Matsumoto et al.
5,645,485 A 7/1997 Clapper, Jr.
5,647,798 A 7/1997 Falciglia
5,655,961 A 8/1997 Acres et al.
5,678,001 A 10/1997 Nagel et al.
5,707,285 A 1/1998 Place et al.
5,711,715 A 1/1998 Ringo et al.
5,718,431 A * 2/1998 Ornstein ..... 273/292
5,720,662 A 2/1998 Holmes, Jr. et al.
5,722,891 A 3/1998 Inoue
5,725,428 A 3/1998 Achmüller
5,732,950 A 3/1998 Moody
5,755,440 A 5/1998 Sher
5,766,074 A 6/1998 Cannon et al.
5,769,716 A 6/1998 Saffari et al.
5,772,506 A 6/1998 Marks et al.
5,772,509 A 6/1998 Weiss
5,775,692 A 7/1998 Watts et al.
5,779,239 A 7/1998 Lind
5,788,573 A 8/1998 Baerlocher et al.
5,791,649 A * 8/1998 DiSandro ..... 273/243
5,791,987 A 8/1998 Chen et al.
5,806,847 A * 9/1998 White et al. ..... 273/309
5,807,172 A 9/1998 Piechowiak
5,810,361 A 9/1998 Kadlic
5,816,916 A 10/1998 Moody
5,816,918 A 10/1998 Kelly et al.
5,823,873 A 10/1998 Moody
5,823,874 A 10/1998 Adams
D400,597 S 11/1998 Hedrick et al.
5,833,537 A 11/1998 Barrie
5,848,932 A 12/1998 Adams
5,855,514 A 1/1999 Kamille
5,857,909 A * 1/1999 Rubin ..... 463/17
5,863,041 A 1/1999 Boylan
5,868,619 A 2/1999 Wood et al.
5,876,284 A 3/1999 Acres et al.
5,882,105 A 3/1999 Barlow
5,882,258 A 3/1999 Kelly et al.
5,882,261 A 3/1999 Adams
5,890,962 A 4/1999 Takemoto
5,902,184 A 5/1999 Bennett
5,910,048 A 6/1999 Feinberg
5,911,418 A * 6/1999 Adams ..... 273/274
5,918,880 A 7/1999 Voigt, IV et al.
5,934,672 A 8/1999 Sines et al.
5,935,002 A 8/1999 Falciglia
5,947,820 A 9/1999 Morro et al.
5,951,397 A 9/1999 Dickinson
5,954,335 A 9/1999 Moody
5,964,463 A 10/1999 Moore, Jr.
5,967,893 A 10/1999 Lawrence et al.
5,971,849 A 10/1999 Falciglia
5,976,016 A 11/1999 Moody et al.
5,980,384 A 11/1999 Barrie
5,984,310 A 11/1999 English
5,984,781 A 11/1999 Sunaga
5,984,782 A 11/1999 Inoue
5,988,638 A 11/1999 Rodesch et al.
5,993,316 A 11/1999 Coyle et al.
5,997,000 A * 12/1999 Nakano et al. ..... 273/274

5,997,401 A 12/1999 Crawford
6,003,867 A 12/1999 Rodesch et al.
6,004,207 A 12/1999 Wilson, Jr. et al.
6,007,066 A 12/1999 Moody
6,007,424 A 12/1999 Evers et al.
6,012,720 A 1/2000 Webb
6,012,981 A 1/2000 Fujioka et al.
6,012,982 A 1/2000 Piechowiak et al.
6,012,983 A 1/2000 Walker et al.
6,032,955 A 3/2000 Luciano et al.
6,033,307 A 3/2000 Vancura
6,047,963 A 4/2000 Pierce et al.
6,053,823 A 4/2000 Mathews
6,056,642 A 5/2000 Bennett
6,059,289 A 5/2000 Vancura
6,059,658 A 5/2000 Mangano et al.
6,062,980 A 5/2000 Luciano
6,062,981 A 5/2000 Luciano, Jr.
6,070,872 A * 6/2000 Squitieri ..... 273/292
6,071,192 A 6/2000 Weiss
6,083,105 A 7/2000 Ronin et al.
6,089,977 A 7/2000 Bennett
6,089,978 A 7/2000 Adams
6,089,980 A 7/2000 Gauselmann
6,093,101 A 7/2000 Mourad
6,093,102 A 7/2000 Bennett
6,098,985 A 8/2000 Moody
6,102,400 A 8/2000 Scott et al.
6,102,402 A 8/2000 Scott et al.
6,102,798 A 8/2000 Bennett
6,105,962 A 8/2000 Malavazos et al.
6,110,041 A 8/2000 Walker et al.
6,113,098 A 9/2000 Adams
6,120,031 A 9/2000 Adams
6,120,377 A 9/2000 Mcginnis et al.
6,120,378 A 9/2000 Moody et al.
6,126,165 A 10/2000 Sakamoto
6,126,541 A 10/2000 Fuchs
6,126,542 A 10/2000 Fier
6,129,632 A 10/2000 Luciano
6,132,311 A 10/2000 Williams
6,135,884 A 10/2000 Hedrick et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,149,521 A 11/2000 Sanduski
6,155,925 A 12/2000 Giobbi et al.
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,505 B1 * 2/2001 Perrie et al. ..... 273/274
6,186,894 B1 2/2001 Mayeroff
6,190,254 B1 2/2001 Bennett
6,190,255 B1 2/2001 Thomas et al.
6,193,606 B1 2/2001 Walker et al.
6,196,547 B1 3/2001 Pascal et al.
6,203,009 B1 3/2001 Sines et al.
6,203,429 B1 3/2001 Demar et al.
6,209,869 B1 4/2001 Mathews
6,210,277 B1 4/2001 Stefan
6,217,022 B1 4/2001 Astaneha
6,217,448 B1 4/2001 Olsen
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,542 B1 5/2001 Cosmi
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,264,200 B1 7/2001 Smith
6,270,409 B1 8/2001 Shuster
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,302,791 B1 10/2001 Frohm et al.
6,305,686 B1 10/2001 Perrie et al.
6,309,299 B1 10/2001 Weiss
6,311,976 B1 11/2001 Yoseloff et al.
6,312,331 B1 11/2001 Tamaki
6,312,334 B1 11/2001 Yoseloff
6,315,660 B1 11/2001 DeMar et al.
6,315,662 B1 11/2001 Jorasch et al.
6,315,663 B1 11/2001 Sakamoto
6,319,124 B1 11/2001 Baerlocher et al.
6,322,078 B1 11/2001 Adams
6,336,860 B1 1/2002 Webb
6,336,862 B1 1/2002 Byrne
6,336,863 B1 1/2002 Baerlocher et al.
6,340,158 B2 1/2002 Pierce et al.
6,352,260 B1 3/2002 Santiago
6,358,144 B1 3/2002 Kadlic et al.
6,358,147 B1 3/2002 Jaffe et al.
6,364,314 B1 4/2002 Canterbury
6,364,766 B1 4/2002 Anderson et al.
6,364,768 B1 4/2002 Acres et al.
6,368,214 B1 4/2002 Luciano
6,371,853 B1 4/2002 Borta
6,375,569 B1 4/2002 Acres
6,375,570 B1 4/2002 Poole
6,390,470 B1 5/2002 Huang
6,394,902 B1 5/2002 Glavich et al.
6,398,218 B1 6/2002 Vancura
6,398,220 B1 6/2002 Inoue
6,398,644 B1 6/2002 Perrie et al.
6,413,162 B1 7/2002 Baerlocher et al.
6,413,163 B1 7/2002 Yamauchi et al.
6,419,579 B1 7/2002 Bennett
6,428,412 B1 8/2002 Anderson et al.
6,435,505 B1 * 8/2002 Hoffman ..... 273/274
6,435,968 B1 8/2002 Torango
6,439,943 B1 8/2002 Aoki et al.
6,439,993 B1 8/2002 O'Halloran
6,439,995 B1 8/2002 Hughs-Baird et al.
6,443,452 B1 9/2002 Brune
6,443,456 B1 9/2002 Gajor
6,446,965 B1 9/2002 Boulton
6,450,884 B1 9/2002 Seelig et al.
6,454,266 B1 9/2002 Breeding et al.
6,461,241 B1 10/2002 Webb et al.
6,467,770 B1 10/2002 Matosevic
6,471,208 B2 10/2002 Yoseloff et al.
6,474,647 B1 11/2002 Zakhar
6,481,713 B2 11/2002 Perrie et al.
6,491,584 B2 12/2002 Graham et al.

6,494,454 B2 12/2002 Adams
6,497,409 B2 12/2002 Mathews
6,517,432 B1 2/2003 Jaffe
6,520,502 B1 * 2/2003 Drouhard ..... 273/242
6,520,503 B1 * 2/2003 Porto ..... 273/274
6,520,854 B1 2/2003 McNally
6,536,767 B1 * 3/2003 Keller ..... 273/292
6,537,150 B1 3/2003 Luciano et al.
6,537,152 B2 3/2003 Seelig et al.
6,551,187 B1 4/2003 Jaffe
6,561,512 B2 5/2003 Luciano et al.
6,561,904 B2 5/2003 Locke et al.
6,565,088 B2 5/2003 Perrie et al.
6,565,436 B1 5/2003 Baerlocher
6,569,013 B1 5/2003 Taylor
6,575,834 B1 6/2003 Lindo
6,599,185 B1 7/2003 Kaminkow et al.
6,599,193 B2 7/2003 Baerlocher et al.
6,602,136 B1 8/2003 Baerlocher et al.
6,602,137 B2 8/2003 Kaminkow et al.
6,604,740 B1 8/2003 Singer et al.
6,609,969 B1 8/2003 Luciano et al.
6,609,970 B1 8/2003 Luciano, Jr.
6,612,927 B1 9/2003 Slomiany et al.
6,616,142 B2 9/2003 Adams
6,632,139 B1 10/2003 Baerlocher
6,632,140 B2 10/2003 Berman et al.
6,634,942 B2 10/2003 Walker et al.
6,634,945 B2 10/2003 Glavich et al.
6,652,378 B2 11/2003 Cannon et al.
6,656,043 B2 12/2003 Seelig et al.
6,659,462 B1 12/2003 Scott
6,663,106 B1 12/2003 Cosmi
6,666,766 B2 12/2003 Baerlocher et al.
6,682,073 B2 1/2004 Bryant et al.
6,695,696 B1 2/2004 Kaminkow
6,712,693 B1 3/2004 Hettinger
6,712,694 B1 3/2004 Nordman
6,712,695 B2 3/2004 Mothwurf et al.
6,726,563 B1 4/2004 Baerlocher et al.
6,733,389 B2 5/2004 Webb et al.
6,736,397 B2 * 5/2004 Drouhard ..... 273/243
6,739,970 B2 5/2004 Luciano
6,746,016 B2 6/2004 Perrie et al.
6,755,420 B2 * 6/2004 Colton ..... 273/274
6,758,749 B2 7/2004 Krintzman
6,764,396 B2 7/2004 Seelig et al.
6,776,711 B1 8/2004 Baerlocher
6,780,105 B1 8/2004 Kaminkow
6,786,824 B2 9/2004 Cannon
6,802,774 B1 10/2004 Carlson et al.
6,802,778 B1 10/2004 Lemay et al.
6,805,349 B2 10/2004 Baerlocher et al.
6,811,483 B1 11/2004 Webb et al.
6,857,957 B2 2/2005 Marks et al.
6,869,359 B1 3/2005 Mathews
6,869,360 B2 3/2005 Marks et al.
6,878,061 B2 4/2005 Baerlocher et al.
6,884,167 B2 4/2005 Walker et al.
6,887,157 B2 5/2005 Lemay et al.
6,890,255 B2 5/2005 Jarvis et al.
6,890,257 B2 5/2005 Baerlocher
6,899,620 B2 5/2005 Kaminkow et al.
6,905,406 B2 6/2005 Kaminkow et al.
6,908,383 B2 * 6/2005 Baerlocher et al. ..... 463/20
6,913,262 B2 7/2005 Berman
6,913,532 B2 7/2005 Baerlocher et al.
6,916,245 B1 7/2005 Vancura et al.
6,921,072 B2 7/2005 Hughes-Watts
6,921,335 B2 7/2005 Rodgers et al.
6,923,720 B2 8/2005 Loose
6,926,607 B2 8/2005 Slomiany et al.
6,929,952 B2 8/2005 Baerlocher
6,932,340 B1 8/2005 Schaefer et al.
6,955,600 B2 10/2005 Glavich et al.
6,960,133 B1 11/2005 Marks et al.
6,974,132 B2 * 12/2005 Sorge ..... 273/274
6,988,731 B2 1/2006 Inoue
6,988,732 B2 1/2006 Vancura
6,991,544 B2 1/2006 Soltys et al.
6,997,803 B2 2/2006 Lemay et al.
7,001,274 B2 2/2006 Baerlocher et al.
7,004,836 B2 2/2006 Kaminkow et al.
7,008,324 B1 3/2006 Johnson et al.
7,014,560 B2 3/2006 Glavich et al.
7,029,395 B1 4/2006 Baerlocher
7,036,817 B2 * 5/2006 Oliva ..... 273/146
7,048,275 B2 5/2006 Adams
7,052,395 B2 5/2006 Glavich et al.
7,066,814 B2 6/2006 Glavich et al.
7,081,050 B2 7/2006 Tarantino
7,094,150 B2 8/2006 Ungaro et al.
7,121,943 B2 10/2006 Webb et al.
7,152,863 B2 * 12/2006 Scheb et al. ..... 273/274
7,153,207 B2 12/2006 Kaminkow et al.
7,153,208 B2 12/2006 Kaminkow et al.
7,156,737 B2 1/2007 Kaminkow et al.
7,169,044 B2 1/2007 Baerlocher et al.
7,172,505 B2 2/2007 Vancura
7,204,488 B2 4/2007 Ilievski
7,204,754 B2 4/2007 Gray et al.
RE39,659 E 5/2007 Luciano et al.
7,210,997 B2 5/2007 Hughs-baird et al.
7,216,867 B1 5/2007 Luciano et al.
RE39,770 E * 8/2007 Promutico ..... 273/274
7,255,350 B2 * 8/2007 Timmons, Sr. ..... 273/274
7,258,609 B2 8/2007 Nordman et al.
7,267,611 B2 9/2007 Slomiany et al.
7,294,054 B2 * 11/2007 Schugar et al. ..... 463/6
7,322,577 B1 * 1/2008 Jaimes-Ojeda ..... 273/274
7,367,562 B2 * 5/2008 Scheb et al. ..... 273/274
7,367,885 B2 5/2008 Escalera et al.
7,520,507 B2 * 4/2009 Gak ..... 273/146
7,568,697 B2 * 8/2009 Silverman ..... 273/146
2001/0003709 A1 6/2001 Adams
2001/0005690 A1 6/2001 Boulton
2001/0009865 A1 7/2001 Demar et al.
2001/0015525 A1 8/2001 Mathews
2001/0018361 A1 8/2001 Acres
2001/0022429 A1 9/2001 Luciano et al.
2001/0023199 A1 9/2001 Walker et al.
2001/0038178 A1 11/2001 Vancura
2002/0010014 A1 1/2002 Parra et al.
2002/0010017 A1 1/2002 Bennett
2002/0036380 A1 3/2002 Perrie et al.
2002/0043766 A1 4/2002 Berman
2002/0052233 A1 5/2002 Gauselmann
2002/0084587 A1 7/2002 Bennett et al.
2002/0086725 A1 7/2002 Fasbender et al.
2002/0137559 A1 9/2002 Baerlocher
2002/0160827 A1 10/2002 Slomiany et al.
2002/0163127 A1 11/2002 Perrie et al.
2002/0165023 A1 11/2002 Brosnan et al.
2002/0169017 A1 11/2002 Visoenik
2002/0187827 A1 12/2002 Blankstein
2002/0193160 A1 12/2002 Tarantino
2003/0025211 A1 2/2003 Bruce et al.
2003/0027623 A1 2/2003 Rose
2003/0030216 A1 2/2003 Endoso
2003/0032479 A1 2/2003 Lemay et al.
2003/0050110 A1 3/2003 Wichinsky
2003/0054873 A1 3/2003 Peterson
2003/0060266 A1 3/2003 Baerlocher
2003/0060269 A1 3/2003 Paulsen et al.
2003/0060272 A1 3/2003 Glavich et al.
2003/0060281 A1 3/2003 Vancura 2003/0069062 A1 4/2003 Shimizu
2003/0069063 A1 4/2003 Bilyeu et al.
2003/0071417 A1 4/2003 Webb
2003/0073483 A1 4/2003 Glavich et al.
2003/0078103 A1 4/2003 Lemay
2003/0092480 A1 5/2003 White et al.
2003/0092490 A1 5/2003 Gauselmann
2003/0094752 A1 5/2003 Mathews et al.
2003/0094761 A1 5/2003 Furuta et al.
2003/0098543 A1 5/2003 Porto
2003/0119574 A1 6/2003 Yang
2003/0144048 A1 7/2003 Silva
2003/0153383 A1 8/2003 Baerlocher et al.
2003/0155708 A1 8/2003 Perrie et al.
2003/0162585 A1 8/2003 Bigelow et al.
2003/0176213 A1 9/2003 Lemay et al.
2003/0195031 A1 10/2003 O'Donovan et al.
2003/0203753 A1 10/2003 Muir et al.
2003/0207707 A1 11/2003 Slomiany et al.
2003/0207713 A1 11/2003 Taylor
2003/0216165 A1 11/2003 Singer et al.
2003/0220137 A1 11/2003 Duhamel
2003/0232651 A1 12/2003 Huard et al.
2004/0002372 A1 1/2004 Rodgers et al.
2004/0002376 A1 1/2004 Swift et al.
2004/0002380 A1 1/2004 Brosnan et al.
2004/0017043 A1 1/2004 Moody
2004/0033831 A1 2/2004 Tarantino
2004/0038731 A1 2/2004 Englman
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0061285 A1 4/2004 Hughes-Watts
2004/0063493 A1 4/2004 Baerlocher
2004/0072609 A1 4/2004 Ungaro et al.
2004/0072612 A1 4/2004 Rodgers et al.
2004/0072614 A1 4/2004 Roukis
2004/0077398 A1 4/2004 Jarvis et al.
2004/0082373 A1 4/2004 Cole et al.
2004/0102244 A1 5/2004 Kryuchkov et al.
2004/0102245 A1 5/2004 Escalera et al.
2004/0104531 A1* 6/2004 Dreaper et al. ..... 273/274
2004/0116177 A1 6/2004 Frost et al.
2004/0137982 A1 7/2004 Cuddy et al.
2004/0147306 A1 7/2004 Randall et al.
2004/0152500 A1 8/2004 Baerlocher
2004/0159590 A1 8/2004 Mothwurf
2004/0162129 A1 8/2004 Nelson
2004/0162130 A1 8/2004 Walker et al.
2004/0178575 A1* 9/2004 Gaygen ..... 273/146
2004/0212150 A1 10/2004 Huard et al.
2004/0219969 A1 11/2004 Casey et al.
2004/0242302 A1 12/2004 Baerlocher
2004/0242315 A1 12/2004 Paulsen et al.
2004/0251624 A1 12/2004 Hodapp et al.
2004/0254011 A1 12/2004 Muskin
2004/0256804 A1 12/2004 Huard et al.
2004/0266510 A1 12/2004 Kojima
2004/0266512 A1 12/2004 Kaminkow
2004/0266517 A1 12/2004 Bleich et al.
2005/0003886 A1 1/2005 Englman et al.
2005/0014548 A1 1/2005 Thomas
2005/0014550 A1 1/2005 Rhoten
2005/0020346 A1 1/2005 Baerlocher
2005/0029745 A1 2/2005 Walker et al.
2005/0037838 A1 2/2005 Dunaevsky et al.
2005/0049026 A1 3/2005 Angel
2005/0049035 A1 3/2005 Baerlocher et al.
2005/0054429 A1 3/2005 Baerlocher et al.
2005/0059481 A1 3/2005 Joshi et al.
2005/0060050 A1 3/2005 Baerlocher
2005/0070354 A1 3/2005 Baerlocher et al.
2005/0075163 A1 4/2005 Cuddy et al.
2005/0079911 A1 4/2005 Nakatsu
2005/0090306 A1 4/2005 Seelig et al.
2005/0130737 A1 6/2005 Englman et al.
2005/0146092 A1* 7/2005 Knight ..... 273/145 R
2005/0161879 A1 7/2005 Scheb et al.
2005/0176494 A1 8/2005 Thomas
2005/0179201 A1 8/2005 Desalvo
2005/0184456 A1* 8/2005 Lowery ..... 273/146
2005/0192076 A1 9/2005 Lowery
2005/0192079 A1 9/2005 Lowery
2005/0215307 A1 9/2005 Jarvis et al.
2005/0215311 A1 9/2005 Hornik et al.
2005/0218590 A1 10/2005 O'Halloran et al.
2005/0233796 A1 10/2005 Baerlocher et al.
2005/0233801 A1 10/2005 Baerlocher et al.
2005/0233803 A1 10/2005 Yang
2005/0255904 A1 11/2005 Duhamel
2005/0282615 A1 12/2005 Englman et al.
2005/0282629 A1 12/2005 Gagner
2005/0285336 A1 12/2005 Ilievski
2005/0285337 A1 12/2005 Durham et al.
2006/0003834 A1 1/2006 Okada
2006/0009283 A1 1/2006 Englman et al.
2006/0009286 A1 1/2006 Durham et al.
2006/0014580 A1 1/2006 Hawthorn
2006/0017225 A1 1/2006 Nicely
2006/0025193 A1 2/2006 Gail et al.
2006/0025211 A1 2/2006 Wilday et al.
2006/0033267 A1* 2/2006 Wong ..... 273/142 R
2006/0066044 A1 3/2006 Dabosh
2006/0069619 A1 3/2006 Walker et al.
2006/0073873 A1 4/2006 Rodgers et al.
2006/0073897 A1 4/2006 Englman et al.
2006/0094495 A1 5/2006 Gelber et al.
2006/0157927 A1 7/2006 O'Halloran et al.
2006/0157928 A1 7/2006 O'Halloran
2006/0163807 A1* 7/2006 Crenshaw et al. ..... 273/146
2006/0170154 A1 8/2006 Matsuno et al.
2006/0170155 A1 8/2006 Silverman
2006/0178191 A1 8/2006 Ellis
2006/0205480 A1 9/2006 Glavich et al.
2006/0217174 A1 9/2006 Walker et al.
2006/0237905 A1 10/2006 Nicely et al.
2006/0246989 A1 11/2006 Glavich et al.
2006/0249899 A1 11/2006 Lease
2006/0287034 A1 12/2006 Englman et al.
2006/0287053 A1 12/2006 Yokota
2007/0021182 A1 1/2007 Gauselmann
2007/0026930 A1* 2/2007 Frost et al. ..... 463/17
2007/0057452 A1 3/2007 Dargue
2007/0060292 A1 3/2007 Peterson
2007/0069459 A1 3/2007 Vidondo
2007/0075488 A1 4/2007 Pececnik
2007/0135203 A1 6/2007 Nicely
2008/0096642 A1* 4/2008 Yoshizawa ..... 463/22
2008/0113713 A1* 5/2008 Fujimoto ..... 463/16
2008/0116639 A1* 5/2008 Ko et al. ..... 273/292
2009/0117992 A1* 5/2009 Jansiri et al. ..... 463/22
2009/0146372 A1* 6/2009 Witz ..... 273/146

FOREIGN PATENT DOCUMENTS

AU P07780 7/1997
AU 199717601 B2 9/1997
AU 199917318 A1 9/1999
AU 200245837 12/2002
DE 3105266 9/1982
DE 3716849 12/1988
DE 19600787 5/1997
DE 19613455 8/1997
DE 19936196 1/2001

| | | | |
|---|---|---|---|
| EP | 60 019 | A1 | 9/1982 |
| EP | 0 558 307 | A2 | 2/1993 |
| EP | 0 753 331 | A2 | 1/1997 |
| EP | 0 874 337 | A1 | 10/1998 |
| EP | 0 926 645 | | 6/1999 |
| EP | 0 945 837 | A2 | 9/1999 |
| EP | 0 981 119 | A2 | 2/2000 |
| EP | 0 984 407 | A2 | 3/2000 |
| EP | 0 989 531 | A2 | 3/2000 |
| EP | 0984408 | A2 | 3/2000 |
| EP | 1 076 321 | A1 | 2/2001 |
| EP | 1 083 531 | A1 | 3/2001 |
| EP | 1 195 730 | A2 | 4/2002 |
| EP | 1 226 851 | | 7/2002 |
| EP | 1 536 388 | A1 | 1/2005 |
| EP | 1 513 114 | A2 | 3/2005 |
| EP | 1 513 116 | A2 | 3/2005 |
| EP | 1 513 117 | A2 | 3/2005 |
| EP | 1 580 701 | A2 | 3/2005 |
| EP | 1 589 501 | A1 | 10/2005 |
| EP | 1 671 684 | | 6/2006 |
| EP | 1 710 000 | | 10/2006 |
| EP | 1 721 642 | | 11/2006 |
| EP | 1 736 215 | | 12/2006 |
| EP | 1 769 828 | | 4/2007 |
| EP | 1 545 728 | B1 | 1/2009 |
| GB | 970806 | | 9/1964 |
| GB | 2 101 380 | | 1/1983 |
| GB | 2 137 392 | A | 10/1984 |
| GB | 2 262 642 | | 6/1993 |
| GB | 2 292 245 | | 2/1996 |
| GB | 2 322 217 | A | 8/1998 |
| GB | 2 354 179 | | 3/2001 |
| GB | 2 358 591 | | 8/2001 |
| GB | 2 371 494 | | 7/2002 |
| GB | 2 382 911 | | 6/2003 |
| GB | 2 387 950 | A | 10/2003 |
| GB | 2 395 139 | | 5/2004 |
| GB | 2 431 362 | | 4/2007 |
| WO | WO 85/00910 | | 2/1985 |
| WO | WO 92/06756 | | 4/1992 |
| WO | WO 97/32285 | | 9/1997 |
| WO | WO 97/38766 | | 10/1997 |
| WO | WO 98/00207 | | 1/1998 |
| WO | WO 99/03078 | | 1/1999 |
| WO | WO 00/32286 | | 6/2000 |
| WO | WO 00/33269 | | 6/2000 |
| WO | WO 00/64545 | | 11/2000 |
| WO | WO 00/66235 | | 11/2000 |
| WO | WO 00/76606 | A1 | 12/2000 |
| WO | WO 01/26019 | A1 | 4/2001 |
| WO | WO 02/38234 | | 5/2002 |
| WO | WO 02/056984 | | 7/2002 |
| WO | WO 02/078804 | | 10/2002 |
| WO | WO 03/002591 | | 1/2003 |
| WO | WO 03/026757 | | 4/2003 |
| WO | WO 03/028828 | | 4/2003 |
| WO | WO 03/035197 | | 5/2003 |
| WO | WO 03/043710 | | 5/2003 |
| WO | WO 2004/023400 | | 3/2004 |
| WO | WO 2004/025584 | A2 | 3/2004 |
| WO | WO 2004/028650 | | 4/2004 |
| WO | WO 2004/052477 | | 6/2004 |
| WO | WO 2005/077480 | | 8/2005 |
| WO | WO 2005/083599 | | 9/2005 |
| WO | WO 2006/015442 | | 2/2006 |
| WO | WO 2006/017431 | | 2/2006 |
| WO | WO 2006/061616 | | 6/2006 |
| WO | WO 2006/078219 | | 7/2006 |
| WO | WO 2006/094398 | | 9/2006 |
| WO | WO 2006/097007 | | 9/2006 |
| WO | WO 2007/024202 | | 3/2007 |
| WO | WO 2007/033430 | | 3/2007 |
| WO | WO 2007/077449 | | 7/2007 |
| WO | WO 2007/080421 | | 7/2007 |

OTHER PUBLICATIONS

3RV—Jackpot Party Advertisement, written by WMS Gaming, Inc., published Aug. 8, 2002.
Alfastreet D8 description, Alfa street Gaming Instruments, available on or before Feb. 23, 2004.
Alfastreet M8 description, Alfa street Gaming Instruments, available on or before Feb. 23, 2004.
American Bandstand Brochure, written by Anchor Games, published in 2001.
Animator, retrieved from the Internet at URL:http://www.tcsjohnhuxley.com.au/products/displays/animator.htm, printed on Nov. 8, 2006.
Big Times Red, White & Blue Advertisement written by IGT, published in 2005.
Black Swan Paytable Display, written by IGT, published prior to 2001.
Blurring the Green-Felt Line, written by International Gaming & Wagering Business, published in Jan. 2003.
Bonus Games Advertisement, written by IGT, published in 1999.
Bonus Roulette Brochure, written by R. Franco, published prior to 2001.
Boot Scootin Article, written by Strictly Slots/Aristocrat Leisure Industries, PTY Ltd., published prior to Jul. 2002.
Break the Spell Advertisement, written by Atronic Casino Technology, Ltd., published in 1999.
Break the Spell Article, written by Strictly Slots/Atronic Casino Technology, Ltd., published in Sep. 2000.
Break the Spell Atronic Web Page, published in Jan. 2001.
Buck's Roulette Brochure, written by R. Franco, published prior to 2001.
Bunco History and Rules, printed from http://world-bunco.com/history.html on May 22, 2000.
Cash Chameleon Article, written by Strictly Slots/Aristocrat Leisure Industries, PTY Ltd., published in Apr. 2001.
Catch A Wave Advertisement, written by IGT, published in Dec. 2000.
Classic Pot of Gold Brochure, written by Ace Coin Equipment Ltd., published prior to 2001.
Cossack Dancer Advertisement, written by Olympic Video Gaming, published prior to 2002.
Creepy and Kooky, written by Frank Legato, published by Strictly Slots in Jul. 2000, pp. 52-54.
Cyberdyne Gaming Brochure, written by Cyberdyne Gaming, published prior to 2001.
Description of Symbol Feature in Australian UFO Gaming Machine, written by Barcrest Ltd., published in 1995.
Dolphin Treasure Advertisement, written by Aristocrat Leisure Industries Pty., Ltd., published in 1996.
Double Diamond Line Advertisement, written by Bally Gaming Systems, published in 2000.
Double Roulette Wheel Excerpt, Loose Change Magazine, Oct. 1993, p. 26.
e-FX Roulette Display, retrieved from the Internet at <URL: file://C:\DOCUME~1\rys\LOCALS~1\Temp\S4M2B8E0.htm>, printed on Nov. 8, 2006.
Elvis Hits Advertisement, written by IGT, published in 1999.
Enchanted Forest™ Gaming Description from Aristocrat, available in 1994.
Enchanted Unicorn Advertisement, written by IGT, published in 2001.
European Search Report from EP Patent Application EP 03 813 403.7, published May 4, 2007.
Family Feud Bullseye advertisement, printed from www.igtonline.com/megajackpots/new_games/family_feud_bullseye_slots.html on Mar. 2, 2005 and available in 2003.
Field Testing New Slots Article, written by Strictly Slots, published in Jul. 2000.
Fishin' Buddies Article, published in Strictly Slots/Anchor Games, published in Apr. 2001.

Frog Prince article, written by International Game Technology, published in 2001.
Fully Automated Wheel, retrieved from the Internet at URL:http://www.nrcgamingsystems.com/our_products.asp, printed on Nov. 1, 2006.
Happy Camper Advertisement, written by IGT, published in 2001.
Introducing the "Smiling Ape" Machine Advertisement (including Joker's Wild Poker description), written by IGT, published prior to 2001.
Jackpot Party Advertisement on website page http://www.wmsgaming.com/products/slot/jpp/index.html, printed on Mar. 21, 2001.
Jackpot Party Brochures and Articles, written by WMS Gaming, Inc., published in Mar. 1998.
Jackpot Party Video 9-Line Advertisement, written by WMS Gaming, Inc., available prior to Feb. 23, 2004.
Jeopardy Advertisement, written by IGT, published in 2000.
Jeopardy Video Slots advertisement, written by IGT, published in 2000.
Jeopardy, MegaJackpots Advertisement, written by IGT, published in 1998.
Joker's Wild Advertisement, written by IGT, published prior to 2001.
Little Devils Brochure, written by IGT, published in 1998.
Little Green Men, Jr. Advertisement, written by A.C. Coin and Slot Services Company, published prior to 2002.
Live Random Dice Machines, written by General Automatic Amusement, published prior to 2001.
Loco Loot Article, written by Strictly Slots/Aristocrat Leisure Industries, PTY Ltd., published in May 2002.
Lucky Dolls, written by Strictly Slots, published in May 2002.
LuminAR (Illuminated Roulette), retrieved from the Internet at URL:http://www.tcsjohnhuxley.com.au/products/roulette/luminar.htm, printed on Oct. 31, 2006.
Mark VII Wheel, retrieved from the Internet at URL:http://www.tcsjohnhuxley.com.au/products/roulette/roulettewheels/markvii.htm, printed on Oct. 31, 2006.
Mauritian Roulette from Ultimate Success Gaming, retrieved from the Internet at URL:http://www.gamingfloor.com/features/usg/MagicR.htm, printed on Oct. 31, 2006.
Megastar Family description, Aristocrat Technologies, Inc., available on or before Feb. 23, 2004.
Mistress of the Dark™ Advertisement, written by IGT, published in 2002.
Monopoly Blackjack Edition Game described in Mikohn brochure, published in 2000.
Monte Carlo advertisement, written by Bally Gaming, Inc., published in 2002.
Mountain Money Article, written by Strictly Slots/Aristocrat Leisure Industries, PTY Ltd., published in Jun. 2002.
Multi-Action Blackjack brochure, http://conjelco.com/faq/bj.html, printed on Jul. 30, 2001.
Multi-Play Poker by Bally Gaming, described in Strictly Slots, published in Dec. 2000.
Multi-Play Poker by Bally Gaming, printed from ballygaming.corn/products/multi-play-poker.html, printed on Apr. 25, 2001.
Odds on Gaming™, Inc. brochure, published by Odds on Gaming, published prior:to 2001.
On the House Advertisement, written by Olympic Video Gaming, published prior to 2002.
Penguin Pays Advertisement, written by Aristocrat Incorporated, published in 1998.
Play It Again Poker Brochure, written by IGT, published in 1999.
Pick a Prize Brochure, written by Acres Gaming Incorporated, published prior to 2001, in or before December thereof.
Power Slotto Brochure, published by AC Coin & Slot, in or before Dec. 2002.
Reel Magic™ Gaming Machine Description, written by IGT, available in 1986.
R&B™ Brochure, published by AC Coin & Slot, published prior to 2001.
Rapid Roulette™, written by John Huxley Ltd., published in 2002.
Roulette Grand Jeu brochure, written by Amatic Industries, published prior to 2001.
Roulette Wheel Analysis, retrieved from the Internet at URL:http://www.tcsjohnhuxley.com.au/products/roulette/roulettewheelanalysis.htm, printed on Oct. 31, 2006.
Roulette Wheels catalog, published by Gaming Partners International SAS, available prior to Nov. 10, 2006.
Roulette, written by Atronic Casino Technology, published in 1999.
Royal Roulette advertisement, written by Barcrest Games, published prior to 2001.
Royal Roulette Brochure, written by Impulse Gaming Ltd., published prior to 2001.
Saturn Data Logger, retrieved from the Internet at URL:http://www.tcsjohnhuxley.com.au/products/roulette/santurndatalogger.htm, printed on Oct. 31, 2006.
Saturn Wheel, retrieved from the Internet at <URL: http://www.tcsjohnhuxley.com.au/products/roulettewheels/saturn.htm>, printed on Oct. 31, 2006.
Silver City Roundup Brochure, published by AC Coin & Slot, published prior to 2001.
Slot Machine Buyer's Handbook, A Consumer's Guide to Slot Machines written by David L. Saul and Daniel R. Mead, published in 1998.
Slot Machines and Coin-Op Games, written by Bill Kurtz, published in 1997.
Slot Machines Article, written by Marshall Fey, published by Reno-Tahoe Specialty, Inc., in 1989.
Slot Machines on Parade, 1st edition, written by Robert N. Geddes and illustrated by Daniel R. Mead, published in 1980.
Slot Machines, A Pictorial History of the First 100 Years, written by Marshall Fey, published by Liberty Belle Books, 1983 1989, 1991, 1994, 1997.
Slotopoly Brochure, written by IGT, published in 1998.
Slots 2003 Article, written by Melissa Raimondi, published in Jan. 2003.
Spin Til You Win Game Description, written by IGT, published in 1996.
Starburst Wheel, retrieved from the Internet at URL:http://www.tcsjohnhuxley.com.au/products/roulette/roulettewheels/starburst.htm, printed on Oct. 31, 2006.
Super Bonus Poker by Bally Gaming, described in Strictly Slots, published in Apr. 2000.
Super Times Pay Poker Advertisement, written by IGT, published in 2003.
Take Your Pick Article, written by Strictly Slots, published in Mar. 2001.
Technique of Victory, written by Odrex, published prior to 2001.
The Basics of Winning Video Poker (Chapter VI Deuces Wild & Chapter VII Jokers Wild) written by J. Edward Allen, published in 1990.
The Latest Buzz Article, written by Bally Gaming Systems, published in Fall 2000.
Top Dollar Brochure, written by IGT, published in 1998.
Totem Pole Advertisement, written by IGT, published in 1997, in or before December thereof.
Tropical Fever Glass, written by IGT, published prior to Apr. 2001.
TURBOREEL by Barcrest (with English Translation), available in 2005.
We Make Gaming Fun! Advertisement, written by WMS Gaming Inc., available prior to Feb. 23, 2004.
Wheel of Fortune Special Edition Classic Spin Video Slots, written by IGT, published before Sep. 30, 2004.
Wheel of Fortune Video advertisement, published by IGT in 1999.
Wheel of Fortune Video Slots advertisement, published by IGT in 2002.
Wheel of Madness Game, described in AC Coin & Slot brochure, published in 2000.

Wheel Spins Bonus (Video Wheel of Fortune) article written by IGT, published before Sep. 30, 2004.
Wild Bear Salmon Run Advertisement, written by IGT, published in 2003.
Wild Streak Advertisement, written by WMS Gaming, Inc., published in Strictly Slots Mar. 2001.
Winning Streak Brochure, written by Aristocrat, published in 1994.
Your Real Key to Gaming Success Advertisement (including Roll Over Beethoven and Wild Fortune), written by Olympic Video Gaming, published prior to Feb. 23, 2004.

* cited by examiner

GAMING SYSTEM HAVING A DICE-BASED GAME WITH A PLURALITY OF WAGER AREAS

PRIORITY CLAIM

This application is a divisional of, and claims priority to, U.S. patent application Ser. No. 11/064,314 filed on Feb. 23, 2005, which claims priority to U.S. Provisional Patent Application Ser. No. 60/547,643 filed on Feb. 23, 2004, and the entire contents of such applications are hereby incorporated herein by reference.

BACKGROUND

The present invention relates to the field of betting games having multiple events and permitting of multiple bets. Specifically, the present invention is an improved method for conducting such a betting game, wherein a bonus reward occurs which pays against underlying game bets, triggered by specified outcome events or by an event independent of the underlying game. In one embodiment, the bonus reward is resolved within the play of the underlying game of chance.

Slot games and other games of chance have experienced significant increases in their popularity and they profitability. Much of this new interest may be credited to a wealth of improvements, including in particular the addition of bonus events and bonus rewards. Such additions exhibit additional ways for the player to win, and so increase the interest in, and excitement of, the game. Despite generally seeing no improvement in their expectation of win, all but the most experienced player are likely to find the extra excitement sufficient justification for additional play.

Such bonus potential may add new elements of interest to multi-outcome/multibet games like roulette, money wheel, dice sum, and simulated racing. A multi-outcome/multi-bet game is herein defined as a game which may produce multiple game outcomes and which offers the player the ability to place bets on these several outcomes. Traditionally, the player must bet on a particular outcome in order to receive any reward for that outcome. Herein we add an improvement which can allow all bets to justify a bonus reward.

The traditional game of roulette consists of a horizontally aligned wheel divided into equal sized sectors, typically referred to as canoes, each said canoe being assigned a non-unique color and a unique number. Typically, the colors available are Red, Black, and Green, and numbers range from 1 to 36, augmented by 0 and 00, although the 00 designation is not universally used. Typically, roulette when played in Europe only utilizes a 0 designation, not a 00.

A round of play commences when, after the players have placed their bets, the house dealer spins the roulette wheel, and subsequently releases a ball into the spinning wheel. The ball eventually comes to rest in one of the canoes on the wheel. The designators assigned to the canoe in which the ball came to rest determine the several outcomes of the game. Such designators consist of the number associated with the canoe, the color, and the odd-of-even attribute. Note: 0 and 00 are not considered either odd or even numbers.

Players may bet on any or all of the result characteristics, the specific number, the color, or the odd/even characteristic. Number bets may be placed on individual numbers, or predefined groups of numbers. Game bets allow betting on 1, 2, 3, 4, 5, 6, 12, or 18 numbers. The larger the group on which the bet is placed, the lower the payout associated. Thus, a bet on the number 7 may be paid at 34 to 1, but a bet on the group 1-12 may be paid at 2 to 1. Typically, players may place an unlimited number of such bets, each bet evaluated independently of other bets, and, if appropriate, paid.

Money wheel (sometimes referred: o as the "Big 6") is another popular casino multi-outcome/multi-bet game. The game consists of a vertically aligned wheel sectioned off into equal sized sectors, each said sector associated with a certain reward amount. Pegs at the edge of the wheel engage a flipper or marker that indicates which sector is the selected one. In an electronic or video game format, lights or highlighting can be used to designate the selected sector. Typically, the probability associated with a lower reward, i.e. the number of sectors associated with such a lower reward, or the programmed likelihood of its occurrence, is higher than the probability associated with a higher reward.

A play is initiated once players have placed one or more bets, by having a sector randomly selected. For a mechanical wheel, this is done by spinning the wheel and determining which sector the flipper denotes. For an electronic or video game version using lights or highlighting, the final sector is often selected by chase-light sequence whereby sectors are lit sequentially until the sequence stops and the final sector lit is designated as the sector selected.

A choice of potential bets are offered for the different outcomes whereby the player will be rewarded if he correctly predicts the reward amount associated with the wheel sector selected. For example, the player can bet that a sector featuring a $1 reward will be selected, or he can bet that the sector featuring a $5 reward, and so forth. Typically, the player is allowed make a number of simultaneous bets.

Another example of a multi-outcome/multi-bet game is a simulated racing game. Such a game uses a multiplicity of avatars engaging in a race, often depicted as horses or other animals or ships, cars, or other vehicles. The player may then bet on the relative finishing position of one or more of the avatars. For example, one electromechanical implementation of this game allows a player to bet on which one of 6 plastic horses will cross the finish line first in a simulated race. One video game implementation permits players to bet on which of 8 turtle characters will cross the finish line first in a simulated race. Often, such games the likelihood that a given avatar will finish first will vary by avator. The reward associated with each avatar varies accordingly.

Yet another multi-outcome/multi-bet game is a dice sum game such as Craps or Sic Bo. Certain sums are more like to occur than other sums. For example, there is only way to roll a sum of 12 with two dice (6+6), but there are six ways to roll a sum of 7 (6+1, 5+2, 4+3, 3+4, 2+5, 1+6). Such a game can be offered such that multiple simultaneous bets are possible.

Such multi-outcome/multi-bet games typically do not include a bonus reward component. As other categories of games have benefited from the popularity of such innovations, so too may these, and other, multi-outcome/multi-bet games.

SUMMARY

This invention involves adding a bonus structure to multi-outcome/multi-bet casino games which pays against the bets made on the underlying game. Such bonus events can be triggered by a standard outcome of the underlying game upon which the player can bet, or an additional outcome of the underlying game upon which the player cannot bet, or by an event independent of the underlying game This invention further involves adding a bonus structure to multi-outcome/multi-bet casino games by designating certain rounds as bonus rounds with special rules and/or pay opportunities for wagers placed in the underlying game of chance.

In one optional embodiment, the bonus mechanism is initiated on a random basis by a randomizing technique such as the random selection of a special bonus ball or other such method. This can be accomplished by utilizing balls of different colors, at least one of which is designated as a bonus triggering event, or by an external event such as spinning a wheel, drawing a card from a shuffled deck, etc. Alternatively, the bonus mechanism may be implicated as a result of a game outcome, with specified game outcomes being designated as bonus triggering events. In another alternative embodiment, the bonus mechanism might be implicated whenever a standard game wager, or a selected group of standard game wagers, exceeds a predefined minimum.

In an optional embodiment, a bonus round for such an improved game could involve multiple spins not requiring the placing of an additional wager, or an increase in the reward amounts for winning outcomes during that round. A bonus round could also invoke an independent proposition which could lead to a specific reward or to an increase in a normal game reward. For example, a spinner could randomly specify a multiplier effect for any reward won in the standard game or in the bonus round.

In another optional embodiment, when applied to the game of roulette, this invention could involve the addition of at least one bonus sector or canoe. If the ball lands in such a bonus canoe, this could constitute a bonus triggering event. In one optional embodiment, such an event might increase a bonus accumulator. When such bonus accumulator reaches a predefined threshold amount, a bonus round could be initiated. In an alternate embodiment, a bonus event could be directly initiated upon having the ball land in a bonus canoe.

In one optional embodiment, the bonus event could lead to a direct pay based upon total bets. In another optional embodiment, the bonus event could be a special bonus spin. In such an embodiment, the original wagers could stand and any payout for winning outcomes in the bonus spin could be larger than standard, e.g. double the standard amount. Alternatively, the original wagers could stand and the player get a multiplicity of bonus spins, e.g. two free bonus spins. In an alternate embodiment, rather than a reward of 'n' bonus spins, the reward might be a single round utilizing 'n' balls. In an alternate embodiment, this could include a provision that no two bonus balls could share the same canoe or alternatively that multiple bonus balls could share the same canoe.

In an optional embodiment, the outcome of a bonus round might be the bonus triggering outcome. In an optional embodiment, this could negate the prior bonus reward. Alternatively, this could lead to an additional bonus reward. In one such embodiment, this could lead to a bonus round utilizing altered pay characteristics. For example, such a compound bonus triggering event could lead to the selection of a random reward multiplier, said reward multiplier being applied to any bonus reward otherwise generated. In an alternate embodiment, the bonus outcomes could be disabled during the bonus round.

In an optional embodiment, a separate bonus wager may be offered. Such a wager may either be required to receive a bonus reward, or might increase such resulting bonus reward.

In an optional embodiment of this invention being applied to roulette, the probability of a bonus canoe being selected might have different odds of being selected than do standard canoes. In a mechanical device, this can be accomplished by having the bonus canoe be of a different size as the regular, canoes, altering the probability of the roulette ball coining to rest in a bonus canoe. For example, a roulette wheel with 38 regular canoes and 1 bonus canoe could have the bonus canoe twice the size of a standard canoe, thereby making it twice as likely of selection. For an electronic version of this invention, such differentiation of probability may be accomplished by such programming as is currently known in the art.

The above alternate implementations may be applied in similar ways to a money wheel type game. A bonus sector might be added to the wheel, as could secondary or bonus flippers or markers.

The present invention might also be applied to games of simulated racing. In such games, a bonus can be initiated by the final position of a specified avatar. For example, a bonus could be activated if the most favored avatar (the avatar with the highest probability of finishing first) finishes the simulated race last. Alternatively, a special bonus avatar might be utilized, on which no bets could be placed and whose sole purpose would be the triggering of a bonus outcome. Such alternatives might implicate a single avatar, or a multiplicity of avatars, and might involve finishing first, last, or at any other predesignated positions.

This invention may also be applied to a dice sum game, wherein certain outcomes can be specified as, bonus triggering outcomes. Bonus rewards may be of types previously. defined. Alternatively, the dice sum game may utilize alternate bonus reward mechanisms.

In one such mechanism, a bonus event can be initiated which determines bonus rewards based upon the cumulative total of the bonus triggering outcome and one or more subsequent game outcomes. Thus, if for example dice throws totaling 3 or 11 are specified as bonusing initiating outcomes, a player rolling an 11 in the underlying game would initiate a bonus reward. If, on his next roll such player were to roll a 12, this would be accumulated with the prior roll of 11 for a total of 23. As summation of multiple rolls allows totals exceeding that of an ordinary play of the game, special bonus rewards might be accorded on such higher totals only. Alternately the accumulation might be performed in a wrap around methodology, using "modular arithmetic" or its equivalent.

In one such implementation, a bonus mechanism game can be created where the cumulative totals are indicated along the edges of a square or rectangle. For example, the values 1 through 5 might be indicated along one edge of a square, 5 through 9 along the next edge, 9 through 13 along the next edge and 13,14, 15, 16, 1 along the last edge. Moving about this square on each bonus triggering or bonus roll causes such total to "wrap" whenever it exceeds 16. For example, using the previous example of a bonus roll of 12 following a bonus triggering roll of 11 yields a total of 23, but in a board configuration, this results in a value of 7. (Utilizing modular arithmetic notation, 12+11=7(16).) Therefore the cumulative value of 7 would be used for bonus reward determination.

In another alternative, such bonus reward mechanism might continue as long as designated bonus continuing outcomes are generated. For example, if a bonus roll is a double, two die of matching value, an additional bonus roll might be involved. Should the bonus reward resolution indicate a bonus reward following each bonus triggering roll and each bonus roll, this would cause a continue, and growing, bonus reward. Additionally, the bonus rewards so determined could be altered each time the bonus square is completed, i.e. each time the cumulative total exceeds 16 and is thereby modulated.

Additional features and advantages are described herein, and will be apparent from the following Detailed Description and the figures.

DETAILED DESCRIPTION

Figure 1:
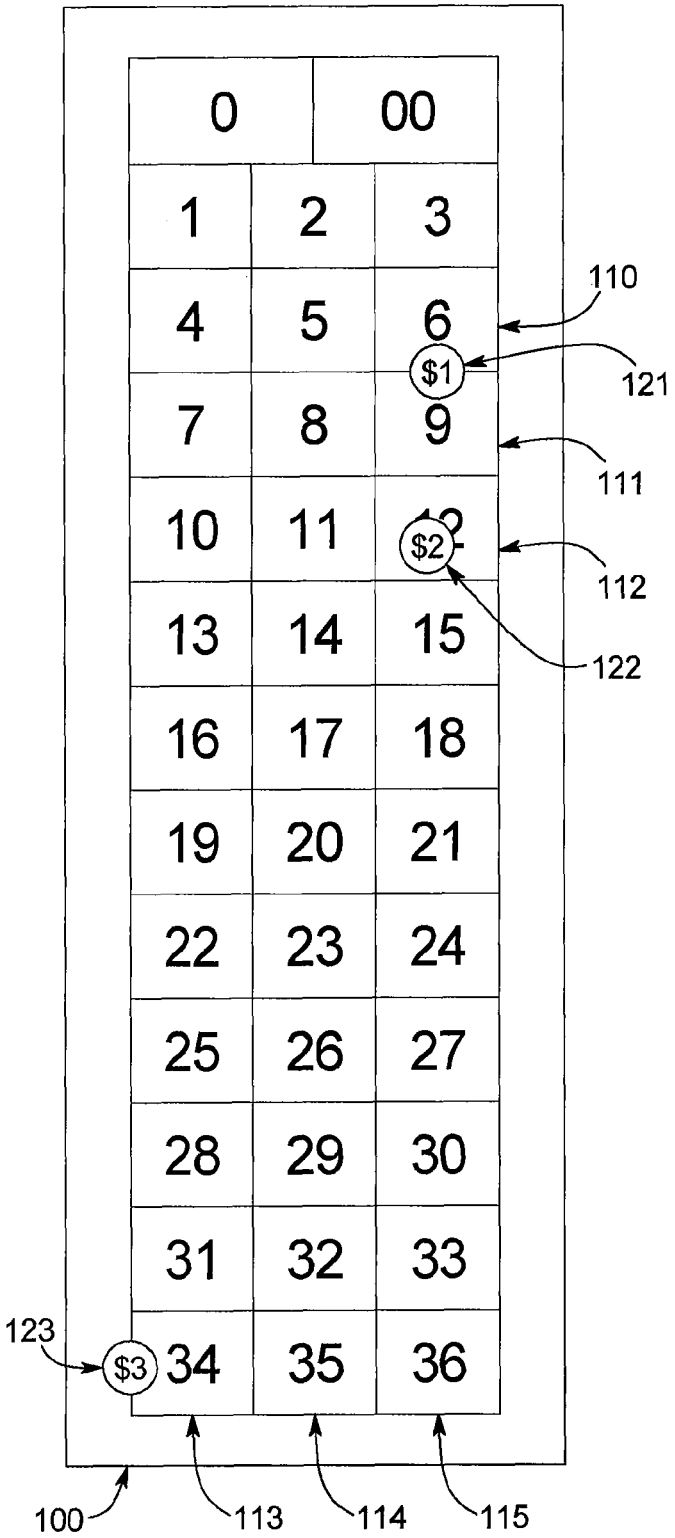
FIG. 1 is a top view of a roulette inside bet area.

Reference is now made to the figures wherein like parts are referred to by like numerals throughout. Throughout the optional embodiments illustrated herein, it is contemplated that the term "bonus rewards" are determined based upon wagers placed the underlying game. Furthermore, bonus rounds may be of fixed duration, or may be of a length as determined by outcomes generated during the execution of the bonus rounds, said results extending or curtailing the bonus generation as indicated according to the prespecified rules of play.

For purposes of illustration, bonus triggering and bonus extending outcomes are predefined per prespecified rules of play. In alternate embodiments, such bonus triggering and bonus extending outcomes may be randomly, and dynamically, defined.

Figure Illustrates the traditional roulette inside wagering area 100 including sample wagers 121, 122, 123. All game outcomes comprising the standard roulette wheel are represented within this inside wagering area 100. Wagers 121, 122, 123 may be placed which will be rewarded on the occurrence of one or more of these standard game results. The $1 wager 121 will be rewarded should either of two game outcomes, "6" 110 or "9" 111, occur. The $2 wager 0.122 will be rewarded only should the outcome "12" 112 occur. The $3 wager 123 will be rewarded if any one of three outcomes, "34" 113, "35" 114 or "36" 115, occur.

Figure 2:
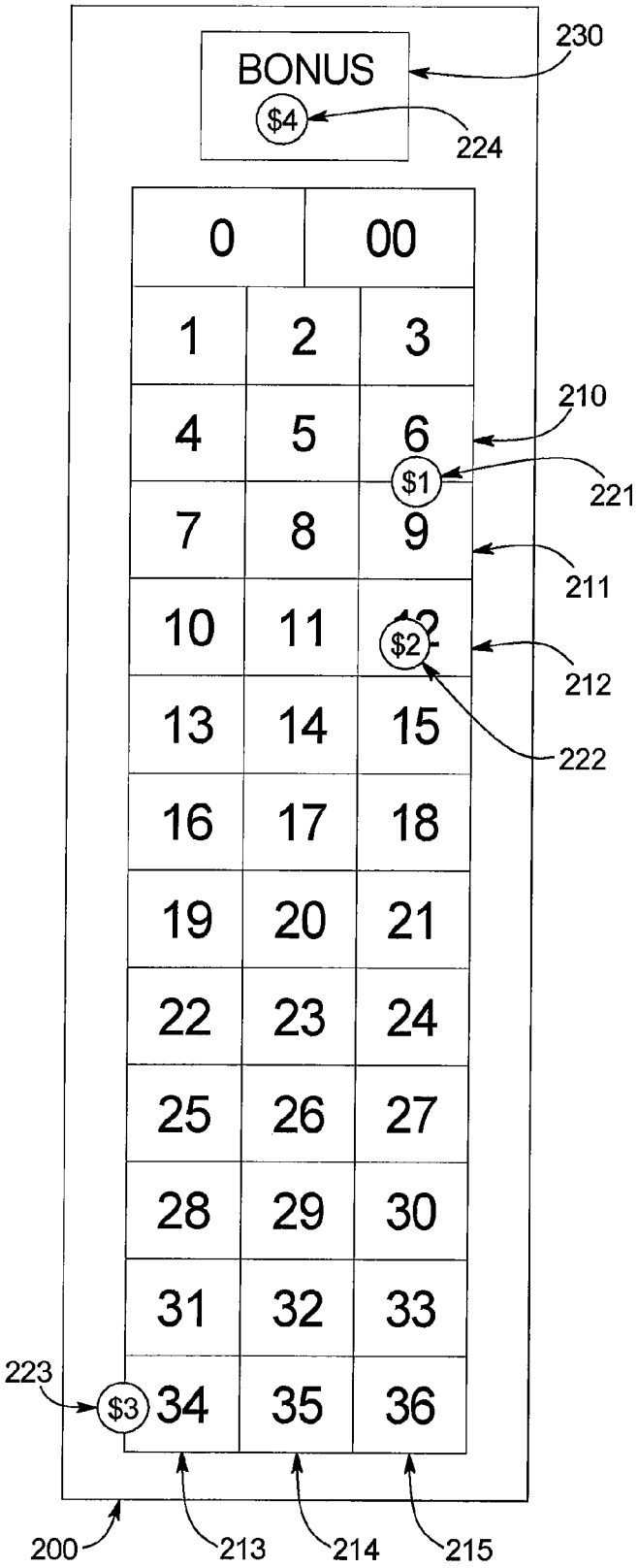
FIG. 2 is a top view of a roulette inside bet area with separate bonus bet area according to an embodiment of the present invention.

FIG. 2 depicts an alternate embodiment of a roulette inside wagering area 200 which has added a bonus wagering location 230. A sample $4 bonus wager 224 is illustrated, betting solely on such a bonus outcome. Non-bonus wagers made in this game 221, 222, 223, are nonetheless eligible for bonus rewards as determined in the bonus event whether or not a bonus wager 224 has been placed. In fact, in an alternate embodiment of this game, such a bonus wager 230 need not be available, and the inside wagering area 200 for such bonus-enhanced games may be indistinguishable from the inside wagering area 100 for the standard game as shown in FIG. 1.

Figure 3:
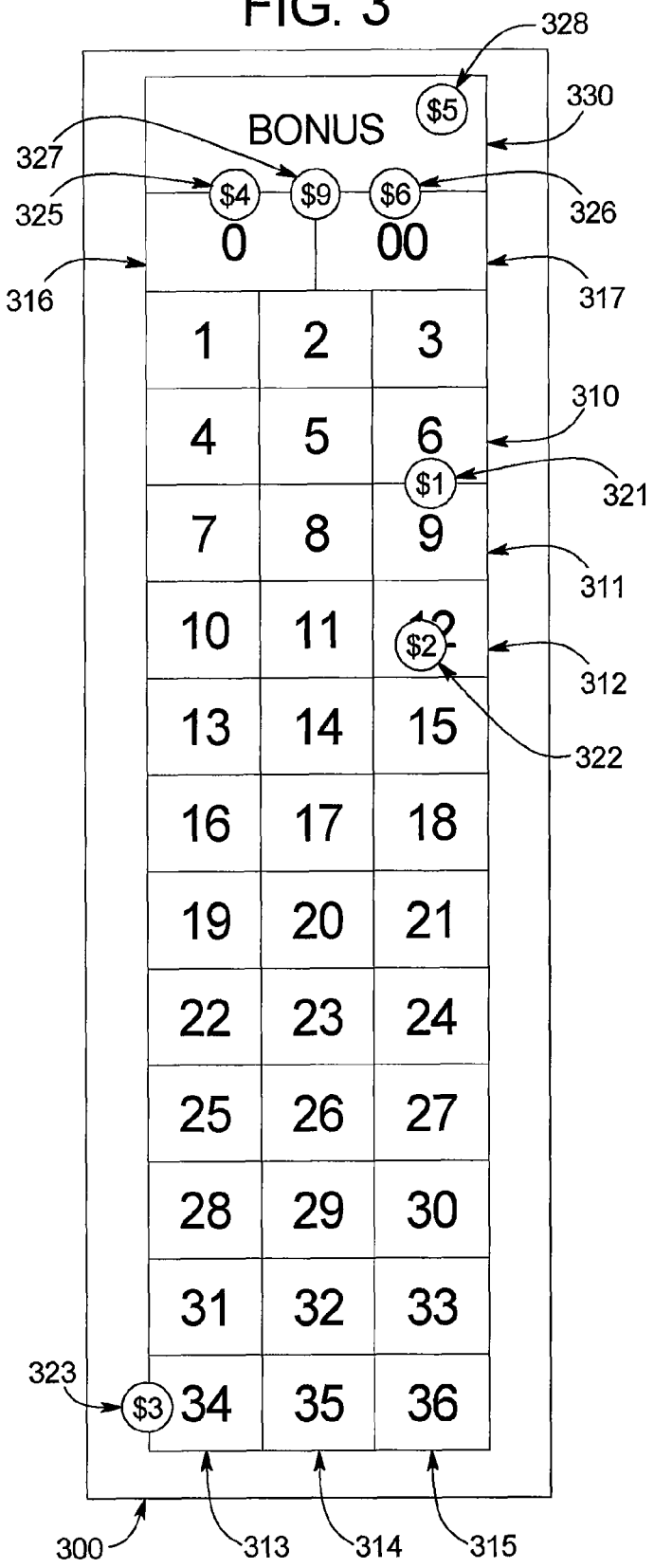
FIG. 3 is a top view of a roulette inside bet area with bonus bet area integrated at top according to an embodiment of the present invention.

FIG. 3 depicts an alternate embodiment of a roulette inside wagering area 300 wherein the bonus wagering opportunity 330 has been integrated into the standard wagering design. In addition to such bonus wagers as previously described 328, this embodiment facilitates wagers on combinations of game and bonus outcomes 325, 326. and 327. The $4 sample wager 325 is rewarded should either a bonus outcome 330 occur or should a "0" 316 occur. This effectively places a $2 wager on a bonus outcome 330 and a $2 wager on the "0" outcome 316. The $6 sample wager 326 is rewarded should either a bonus outcome 330 occur or should a "00" 317 occur. This effectively places a $3 wager on a bonus outcome 330 and a $3 wager on the "00" outcome 317. The $9 sample wager 326 is rewarded should bonus outcome 330 occur, should a "0" 316 occur, or should a "00" 317 occur. This effectively places a $3 wager on a bonus outcome 339, a $3 wager on the "0" outcome 316, and a $3 wager on the "00" outcome 317. For purpose of illustrations, amounts wagered were varied for descriptive clarity, but in an actual game, all of the wagers can typically be of the same amount.

In general, wagers on combinations of numbers offer two advantages: 1) they allow a player to have some control balancing risk and reward, wherein a wager on a larger set of potential winning outcomes increases the probability of obtaining such a winning outcome, but reduces the ratio of the reward of such a winning outcome to the amount wagered, and 2) combination wagers simplify the practice of placing multiple wagers, in particular where the size of the combination wager is large enough to approximate the sum of the equivalent individual wagers. For example, the $3 combination wager 323 for outcomes "34" 313, "35" 314 and "36" 315 could be made as three separate $1 wagers, one on each of the indicated outcomes, should $1 wagers be permitted, but placing a single combination wager 323 requires less effort, on the part of the player as well as on the house. Furthermore, if the minimum wager. is $1, the player could make a $1 wager on the combination "34" 313, "35" 314 and "36" 315 even where a wager of $⅓ for each such outcome would not be permitted.

Figure 4:
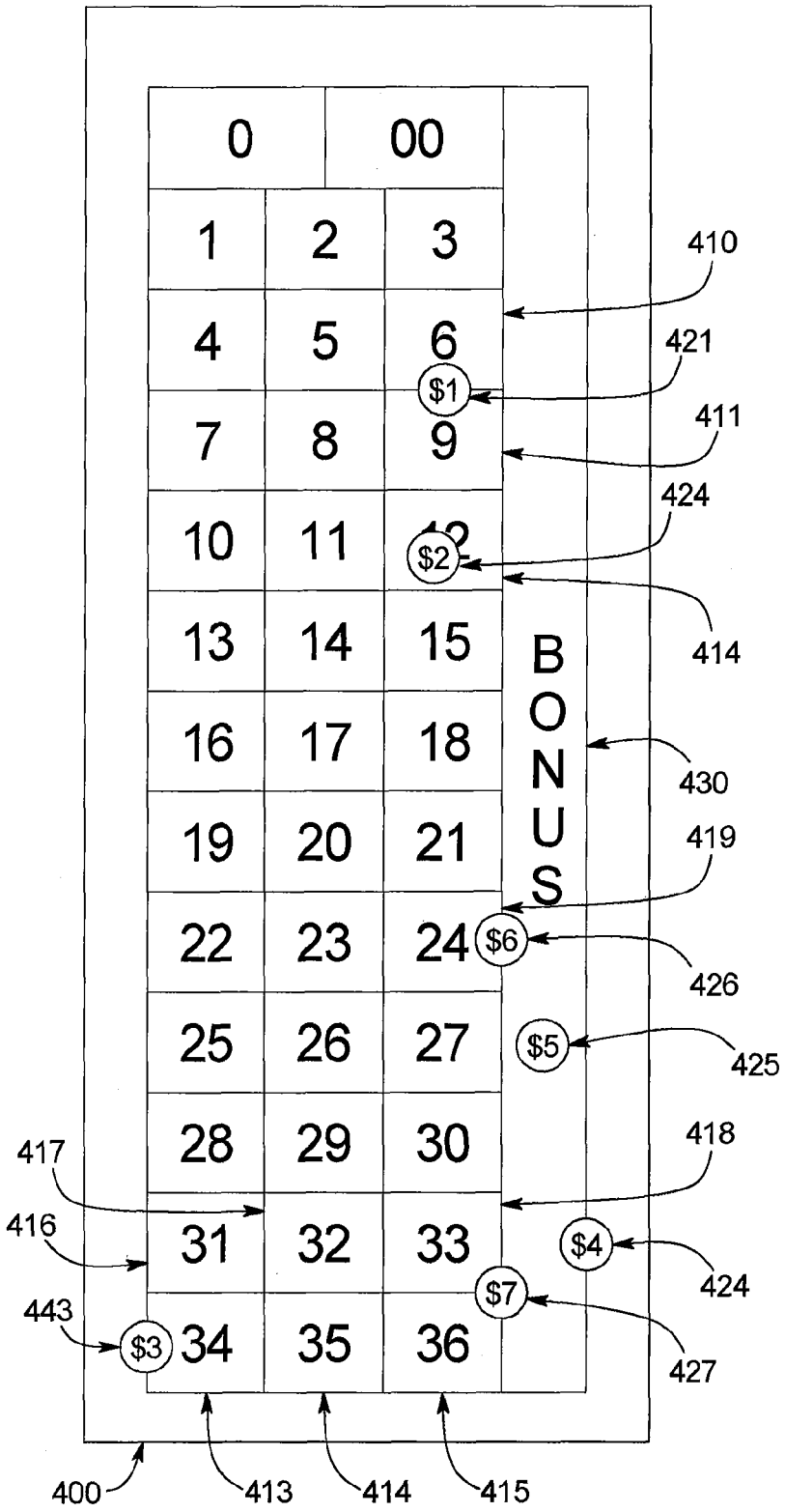
FIG. 4 is a top view of a roulette inside bet area with bonus bet area integrated according to an embodiment of the present invention.

FIG. 4 depicts a roulette inside wagering area 400 with an alternate embodiment of the integration of the bonus wagering location 430. In this embodiment, the bonus wagering location 430 is appended to one of the long sides of the standard inside wagering area 400. In addition to direct bonus wagers 425, this configuration also allows extensive combination wagers which combinations of game. and bonus outcomes 424, 426 and 427. The $6 sample wager 426 is rewarded should a bonus outcome 430 occur or should a "24" 419 occur. This effectively places a $3 wager on a bonus outcome 430 and a $3 wager on the "24" outcome 419. The $4 sample wager 424 is rewarded should a bonus outcome 430 occur, should a "31" 416 occur, should a "32" 417 occur or should a "33" 418 occur. This effectively places a $1 wager on a bonus outcome 430, a $1 wager on an outcome of a "31" 416, a $1 wager on an outcome of a "32" 417, and a $1 wager on an outcome of a "33" 418. The $7 sample wager 427 is rewarded should a bonus outcome 430 occur, should a "31" 416 occur, should a "32" 4.17 occur, should a "33" 418 occur, should a "34" 413 occur, should a "35" 414 occur, or should a "36" 415 occur. This effectively places a $1 wager on a bonus outcome 430 and a $1 wager on each of the outcomes "31", "32", "33", "34", "35" and "36" 413-418. This embodiment still allows game wagers across three numbers such as the sample wager $3 443 on the combination of outcomes "34" 413, "35" 414 and "36" 415 without requiring this combination to also include the bonus outcome.

While not illustrated in the embodiments illustrated, alternate embodiments include configurations wherein combination wagers are available which incorporate bonus wagers with other game wagers, such as the game outside wagers (RED, BLACK, HIGH, LOW, EVEN, ODD, 1st DOZEN, 2nd DOZEN, 3rd DOZEN, 1st COLUMN, 2nd COLUMN, 3rd COLUMN).

While the payouts could take any form and are not restricted to any specific form or quantity, Table 1 illustrates an example pay table for a roulette game according to the embodiment of FIGS. 2-4.

TABLE 1

| Inside Bets | |
|---|---|
| Straight Bets | 35 to 1 |
| Split Bet | 17 to 1 |
| Trio Bet | 11 to 1 |
| Corner Bet | 8 to 1 |
| Five-number Bet | 6 to 1 |
| Six-number Bet | 5 to 1 |
| **Outside Bets** | |
| Dozens | 2 to 1 |
| Column | 2 to 1 |
| Even-odd | 1 to 1 |
| Red-black | 1 to 1 |
| High-low | 1 to 1 |

If Standard Ball Lands on Yellow, All Bets Stand and Double Ball Bonus Round Commences.

| Yellow Bonus Bets | | | |
|---|---|---|---|
| | Standard Ball on Yellow | 1 Bonus Ball on Yellow | Both Bonus Balls on. Yellow |
| Straight Yellow Bet | 12 × Bonus Bet | 120 to 1 | 1200 to 1 |
| Split Yellow Bet | 6 × Bonus Bet | 60 to 1 | 600 to 1 |
| Trio Yellow Bet | 4 × Bonus Bet | 40 to 1 | 400 to 1 |

Figure 5:
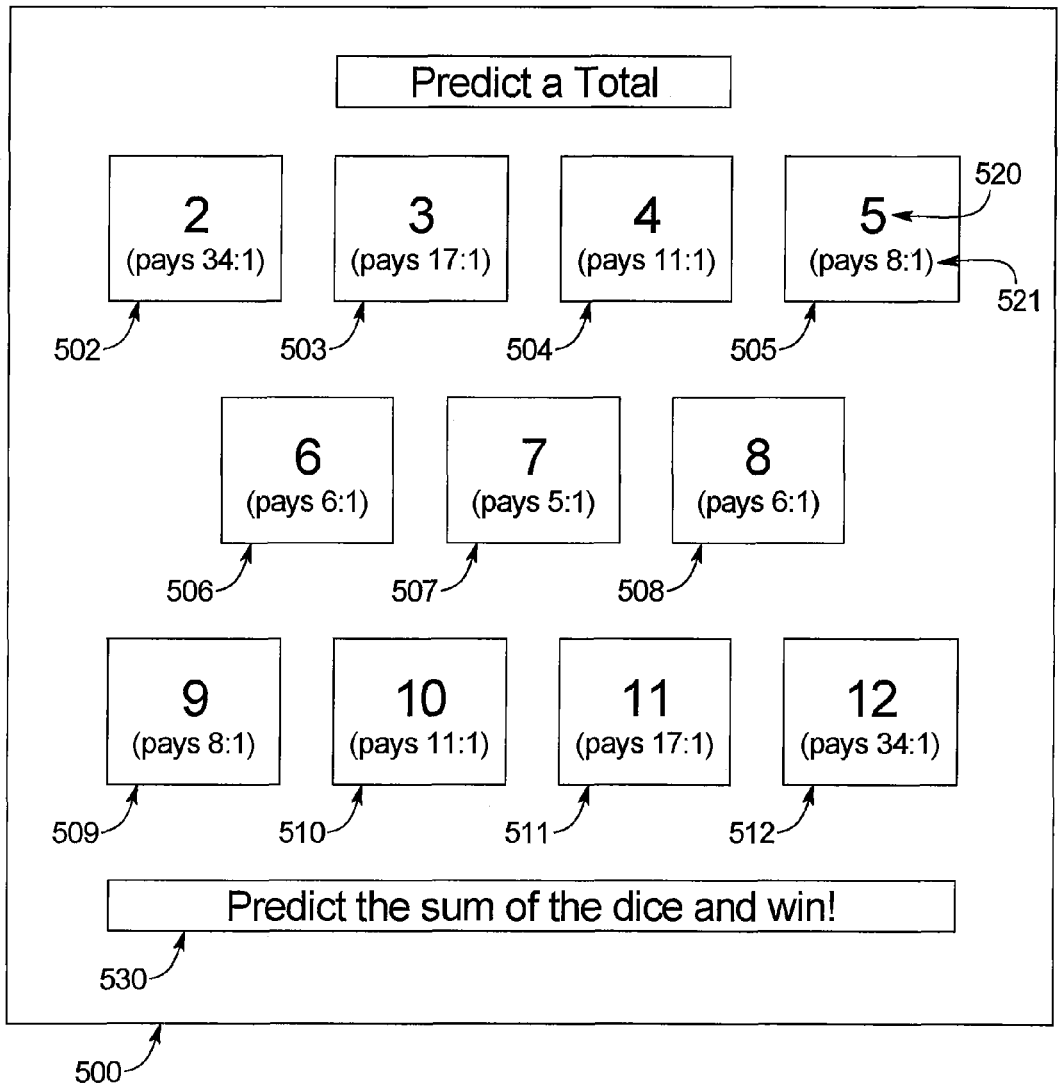
FIG. 5 is a traditional dice sum game.

FIG. 5 depicts an optional embodiment for a traditional dice sum game 500. In this embodiment, the player may place a wager on any of the wagering areas 502 through 512 and as indicated in the instructions 530, and is rewarded if an outcome on which he has wagered results occurs on the next throw of two standard dice. Referring to the wagering area for the outcome "5" 505 as an example, the wagering area lists the outcome being wagered upon 520 and the reward ratio to be paid on such a wager should that outcome 520 occur.

Figure 6:
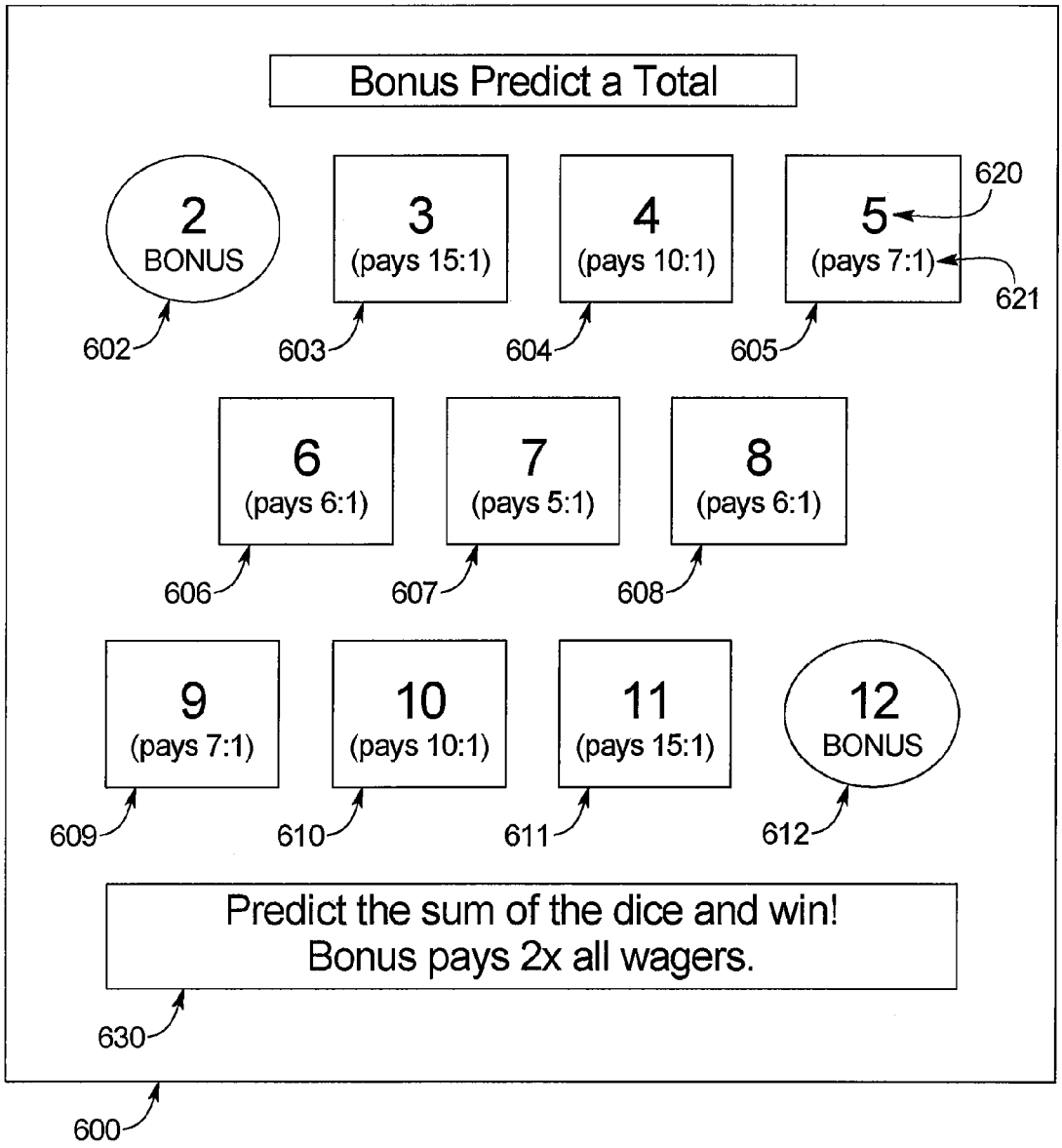
FIG. 6 is a top view of a dice sum game with bonus outcomes according to an embodiment of the present invention.

FIG. 6 illustrates an alternate embodiment 600 of the present invention to that depicted in FIG. 5 500. Two of the outcomes, "2" 602 and "12" 612 are designated as bonus outcomes. In this embodiment, as indicated in the instructions 630, if the outcome of the next throw of two standard dice yields a sum of 2 602 or a sum of 12 612, then player will win twice the total amount wagered in the current play of the game. For example, if the player has wagered $2 on the outcome "6" 606, and $3 on the outcome "8" 608, and the next outcome has a sum of 12, then the player will be paid twice his total wager or $10.

It should be noted that, in this embodiment, the bonus feature increases the expected payback to the player. In order to compensate for such a variation, and still be able to continue to offer this game at a profit, the house may have reduced some of the game rewards. For example, the reward ratio for the outcome "5" 605 has been reduced from 8 to 1 521 in an embodiment corresponding to FIG. 5, to 7 to 1 621 for an embodiment corresponding to FIG. 6. In one optional implementation of this embodiment, players need not place a bonus wager in order to receive a bonus reward. In an alternate implementation of this embodiment, a bonus wager may be a condition precedent for receipt of, or participation in, a bonus reward.

Figure 7:
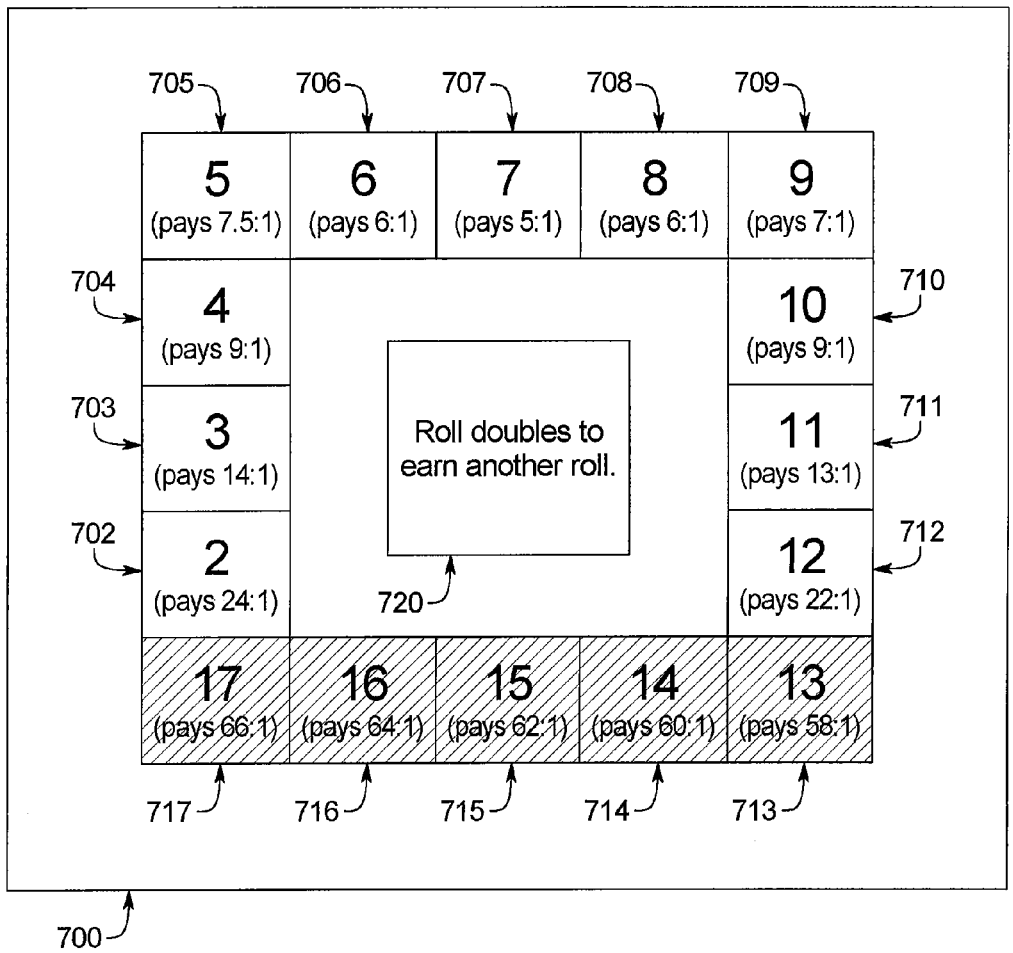
FIG. 7 is a top view of a dice sum game with rethrow and wrap around features according to an embodiment of the present invention.

FIG. 7 illustrates an alternate embodiment of the present invention applied to a dice sum game 700 where the bonus reward is the opportunity to obtain additional reward opportunities should a bonus triggering outcome be generated. In the optional embodiment illustrated, the throwing of "doubles," i.e. where the value on both dice are equal, in other words combinations of 1,1 or 2,2 or 3,3 or 4,4 or 5,5 or 6,6, constitutes such a bonus triggering outcome. In alternative embodiments, other outcomes may be used. The player may wager on any of the outcomes 702 through 717. While outcomes "2" through "12" 702-712 can all be attained in a single role of the dice, outcomes "13" through "17" 713-717 can only be attained by rolling a bonus a double, and then adding the sum of the additional roll awarded. For example, should a player wager on outcome "6" 706 and double 3's were thrown, the player would win 6:1 on his "6" wager 706. However, as a bonus triggering outcome had been thrown, play continues with all wagers standing, independent of wagers placed on "6" 706. Whatever sum is next thrown will be added to the sum of the dice comprising the bonus triggering outcome to generate a new dice sum. For example, if the second roll yields a sum of 10, then the resulting outcome is 10 beyond the current sum or 6+10=16. If the player has a wager on "16" 716, such a player will be rewarded at a payoff of 64:1. Furthermore, if the player's 2nd roll was a 12, then the resulting outcome would be 12 beyond the current 6, which, as this layout utilizes an equivalent of modulo 16 arithmetic, would yield an outcome of 2. In addition, as, in the optional embodiment illustrated, a roll of 12 is double, and hence a bonus extending outcome, the player gets another roll of the dice, with all wagers still standing, with the starting sum now equal to 2. In an optional implementation of this embodiment, a special bonus could be rewarded to all players any time the bonus sum exceeds 17, i.e. "wraps around." For example, any reward paid after having gone around the board once could result in the reward amount being twice as large as normal.

Figure 8:
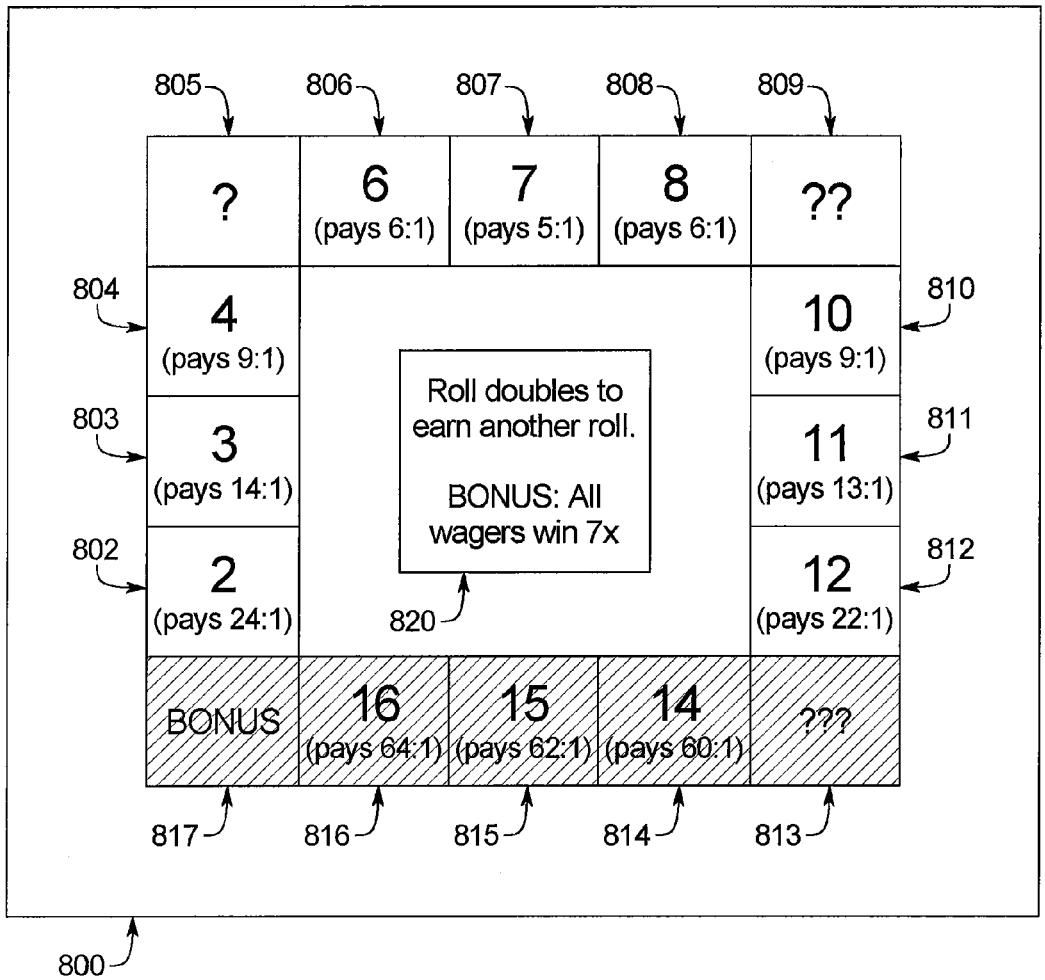
FIG. 8 is a top view of a dice sum game with rethrow and wrap around and bonus square features according to an embodiment of the present invention.

FIG. 8 depicts an alternate embodiment 800 of the game previously depicted in FIG. 7 700 where, in the present embodiment, selected outcomes 805, 809, 813, 817 have been designated to receive bonus outcomes. The bonus "?" 805 arises for an outcome of 5, the bonus "??" 809 arises for an outcome of 9, and the bonus "???" 813 arises for an outcome of 13. In the optional implementation illustrated, the "?" bonus, the "??" bonus, and the "???" bonus each result in an. effect determined at random. Such effects may be accorded as a random relocation to another outcome spot on the board, the ability to throw the dice again from that spot, the granting of a static reward, the granting of a random reward from a series of possible rewards, or even the ending of the game with no reward issued. The potential outcomes, as well as the probabilities of random selection of such potential reward may optionally vary for each such bonus outcome. This game 800 also features a BONUS spot 817 which, as indicated by the game instructions, will result in a reward being paid which is equal to seven times the sum of all placed wagers. Flow logic for this game is presented in FIG. 15.

Figure 9:
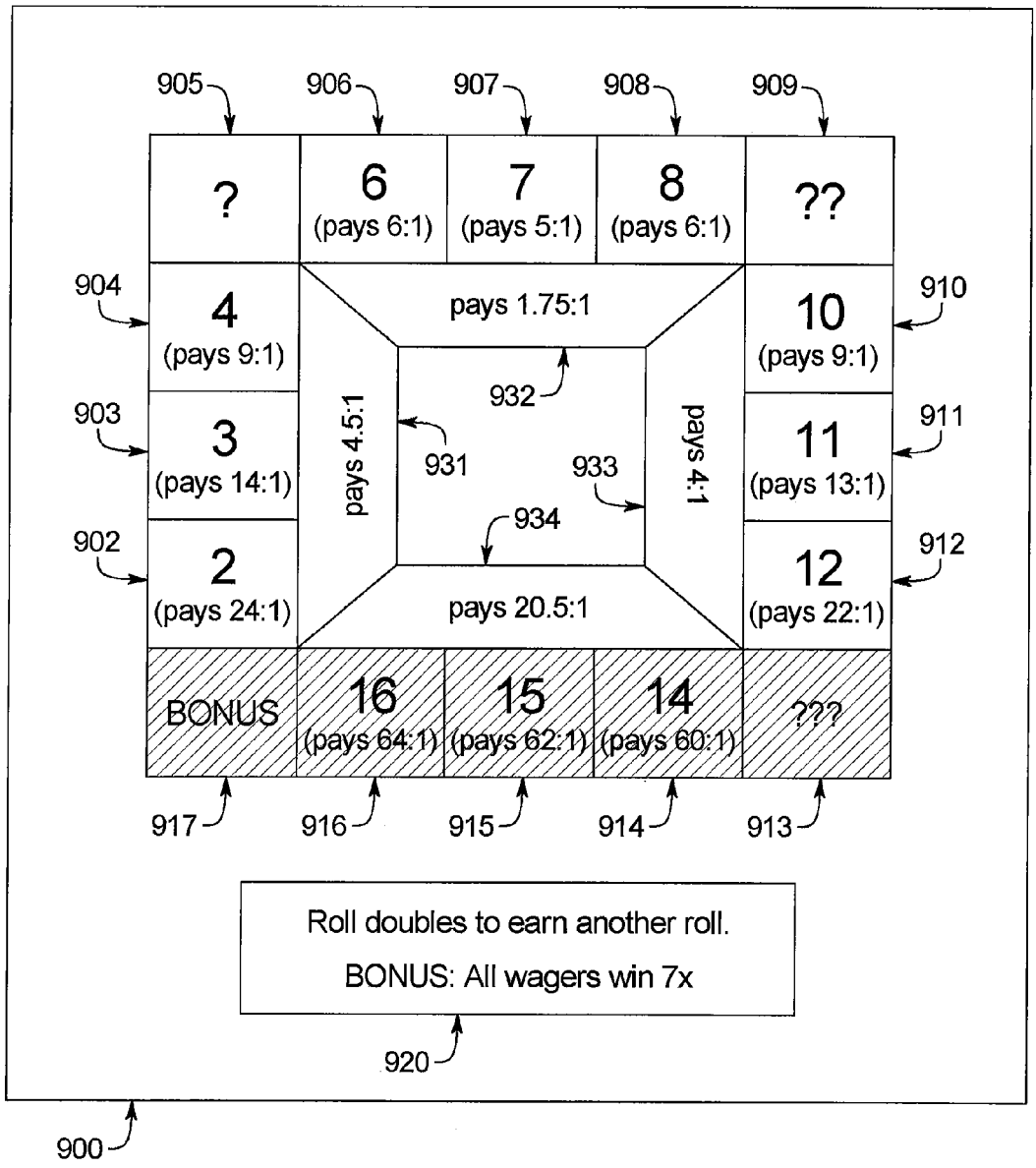
FIG. 9 is a dice sum game with rethrow and wrap around and bonus squares and combination bet features according to an embodiment of the present invention.

FIG. 9 depicts an optional embodiment 900 of the implementation of the present invention which permits of combination wagers on bonus sums. Specifically, there are a new wager opportunities 931 through 934 for combinations of outcomes. A wager on 931 is rewarded at 4.5:1 on an outcome of a "2", "3" or "4." A wager on 932 is rewarded at 1.75:1 for an outcome of "6", "7" or "8," and so forth.

Figure 10:
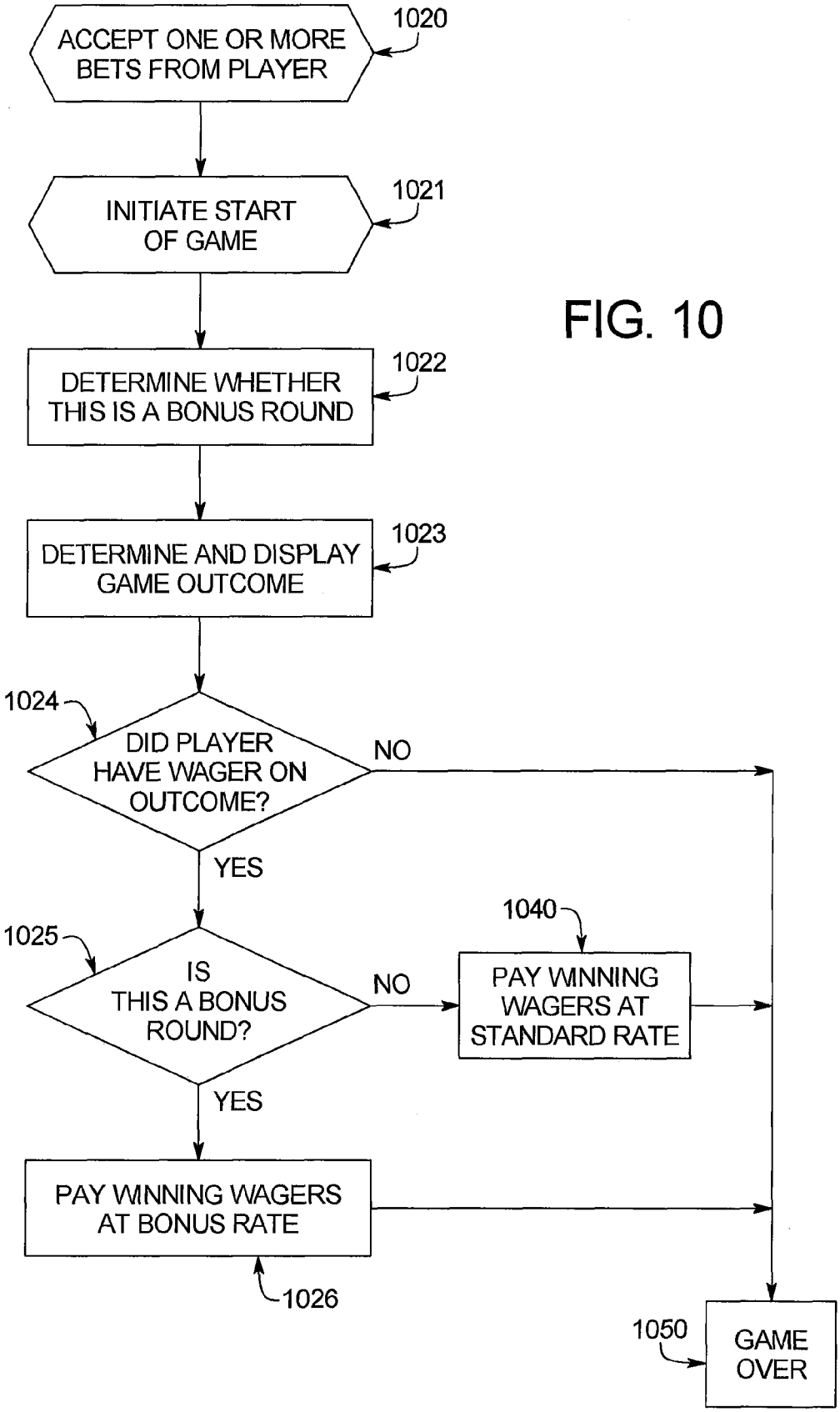
FIG. 10 is a flow diagram of a method with a bonus round selected before outcome according to an embodiment of the present invention.

FIG. 10 shows a logic flow chart of one embodiment of this invention. The player places his wagers 1020 and starts the game 1021. Once the wagers are committed, we determine whether or not this is a bonus round. For one optional implementation of this invention as applied to a Roulette-based game, this could involve the random selection of the roulette ball where at least one designated ball, optionally identified by color, indicates a bonus round. For a Money Wheel-based game, this might optionally involve the random *ling of light colors, at least one of which colors being associated with a bonus round. Alternately, this could involve other selectors such as a secondary spinning wheel, dice or other indicia. The standard game is played out 1023 and an outcome determined. If this outcome was not predicted and wager upon by the player 1024 then the game is over 1050: if the outcome does match a placed wager, then the actual reward is determined based on whether or not this is a bonus round 1025. If it is not a bonus round, then winning outcomes are paid at the standard rate 1040 and the game ends 1050. If it is a bonus round, then the winning outcomes are paid at the higher bonus rate 1026 before the game ends 1050.

Though not shown in this figure, it would also be possible to support different bonus reward structures based upon the bonus selection. For example, in a Roulette-based game, the silver ball could indicate a standard pay while a blue ball indicates a 2× pay and a yellow ball indicates a 3× pay.

Figure 11:
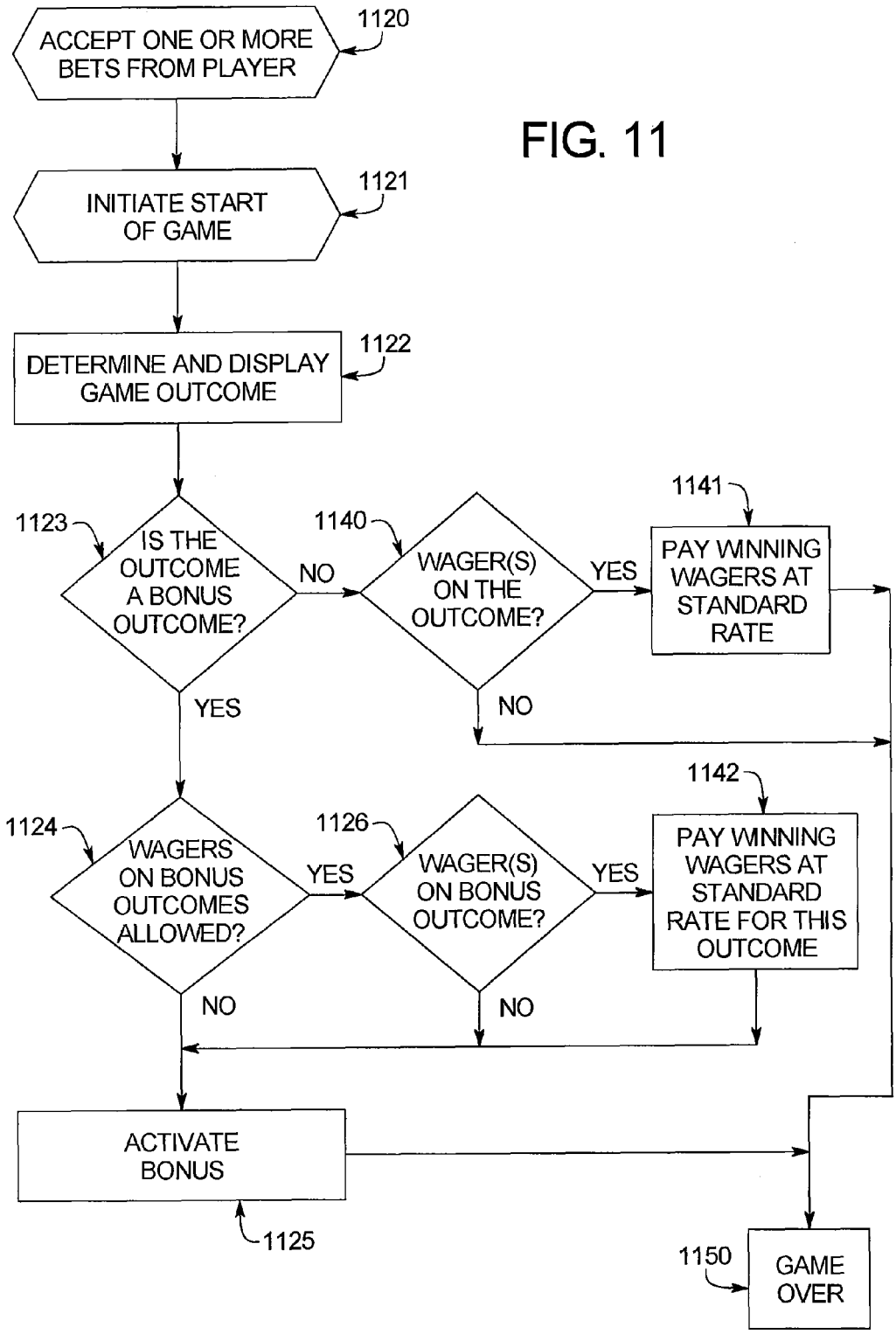
FIG. 11 is a flow diagram of example game with bonus outcomes according to an embodiment of the present invention.

FIG. 11 illustrates the flow chart of an alternate embodiment of this invention. The player places his wagers 1120, the game is started 1121 and the game outcome is determined 1122. If the outcome is not a bonus outcome 1123, then game reward evaluation is performed 1140 to determine whether a game reward should be paid 1141. If this outcome is a bonus outcome, and if the game is defined to allow wagers to be placed on a bonus outcome 1124 and if one or more wagers were made on the bonus outcome 1126 then a reward is paid against said wagers 1142 game. Irrespective of whether or not bonus outcomes are enabled or whether or not bonus outcome wagers were paid and placed, the bonus outcome activates a bonus round 1125.

Figure 12:
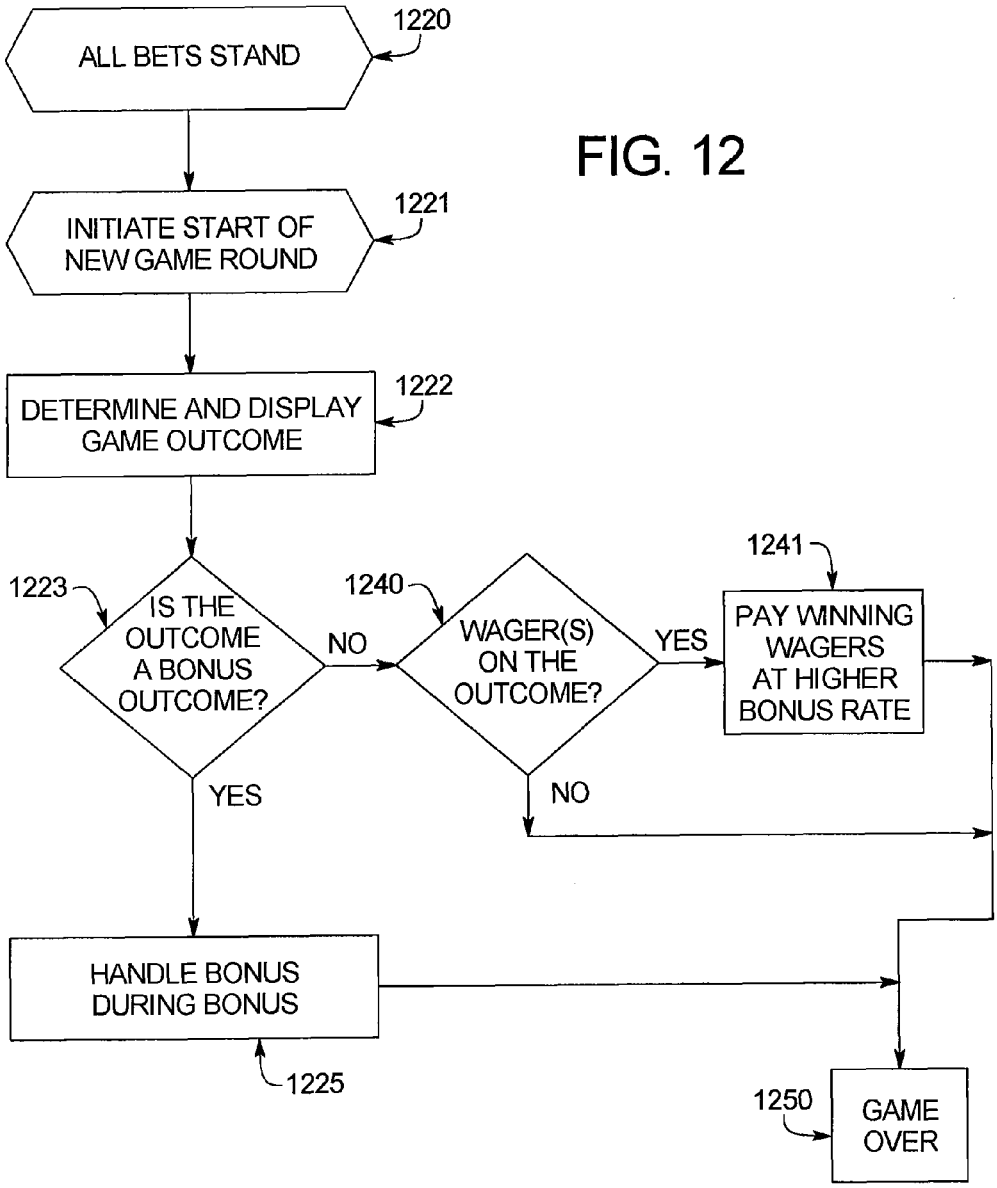
FIG. 12 is a flow diagram of bonus round with one replay at higher reward schedule according to an embodiment of the present invention.

FIG. 12 depicts the flow chart of yet another embodiment of this invention, illustrating one possible bonus outcome activation. All wagers from the original game stand 1220 and another game round is played out 1221 and 1222. If the outcome is not the bonus again 1223, the outcome is compared against the placed wagers 1240 and winnings are paid against such correctly matching wagers 1241, but an adjusted reward rate, typically higher than the normal. An example of such would be to pay out twice as much as usual in the bonus round vs. in a standard round.

A bonus triggering outcome achieved during a bonus round is resolved according to prespecified game rules 1225. This may optionally include activating an additional bonus round at the same reward levels, or activating another bonus round at a modified reward schedule. In one such implementation, this could cause all rewards to be tripled, rather than doubled.

In another such implementation, this could cause all wagers not placed on the bonus outcome to lose. Where the game permits players to place wagers directly on a bonus outcome, then another bonus outcome during a bonus round could lead to special rewards for such bonus wagers.

Figure 13:
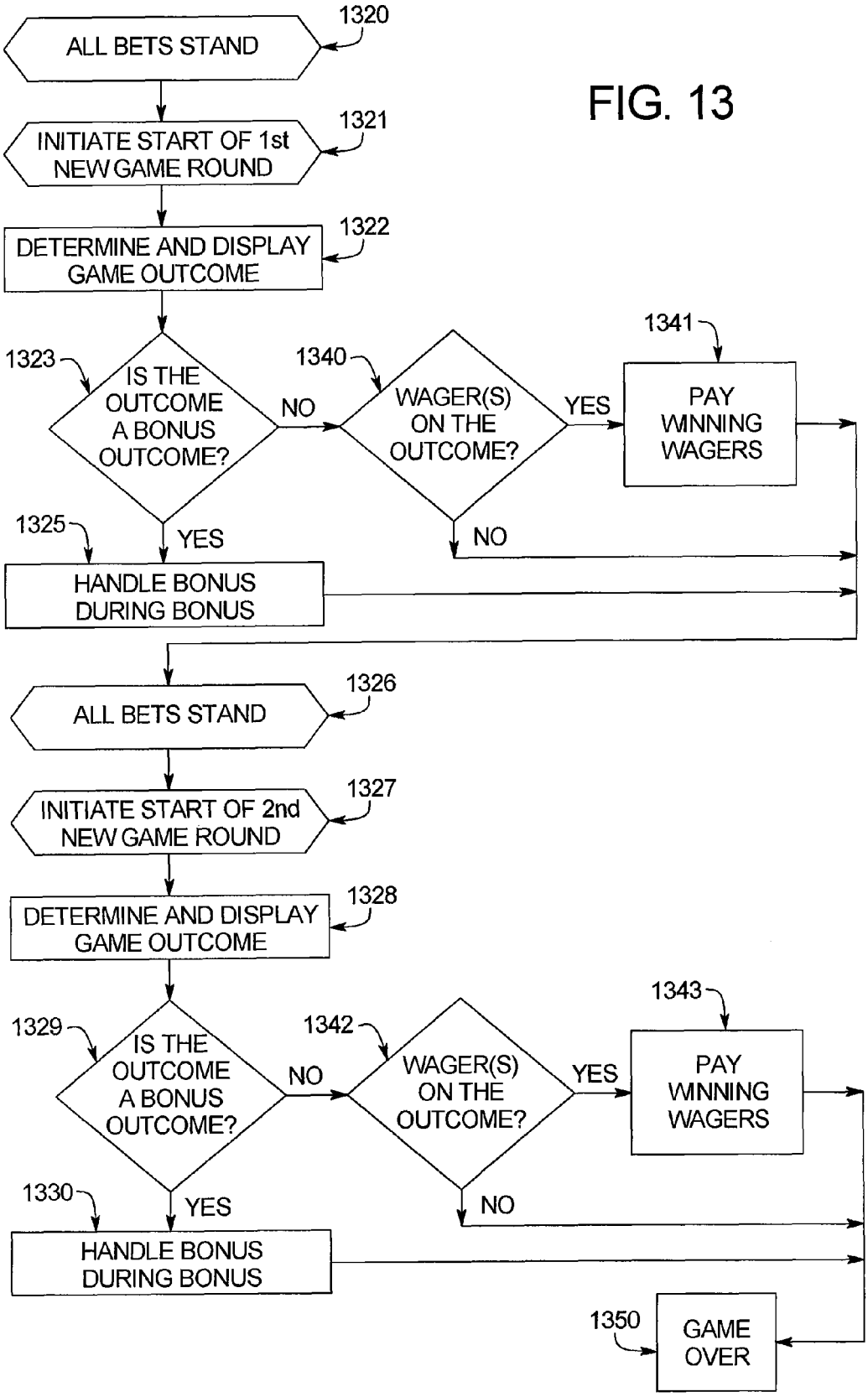
FIG. 13 is a flow diagram of bonus round with multiple sequential replays according to an embodiment of the present invention.

FIG. 13 portrays yet another flow chart of an alternate implementation of this invention, in particular showing one possible bonus outcome activation. In this implementation, all wagers from the original game stand 1320 and the first of at least two game rounds is played out 1321, 1322. If the outcome is not the bonus again 1323, the outcome is compared against the placed wagers 1340 and rewards are paid against such correctly matching wagers 1341. Such rewards could be played out at standard rates or alternatively at special bonus round rates. If the outcome is a bonus outcome, then it can be handled as discussed above. Once the first bonus round is played out, a second bonus round is likewise played out with all wagers from the original game continuing to stand 1326, another round being played out 1327 and 1328 and the results evaluated and acted upon 1329, 1342, 1342, 1330. Clearly, this concept can be easily extended to allow any plurality of bonus rounds to be played out.

Figure 14:
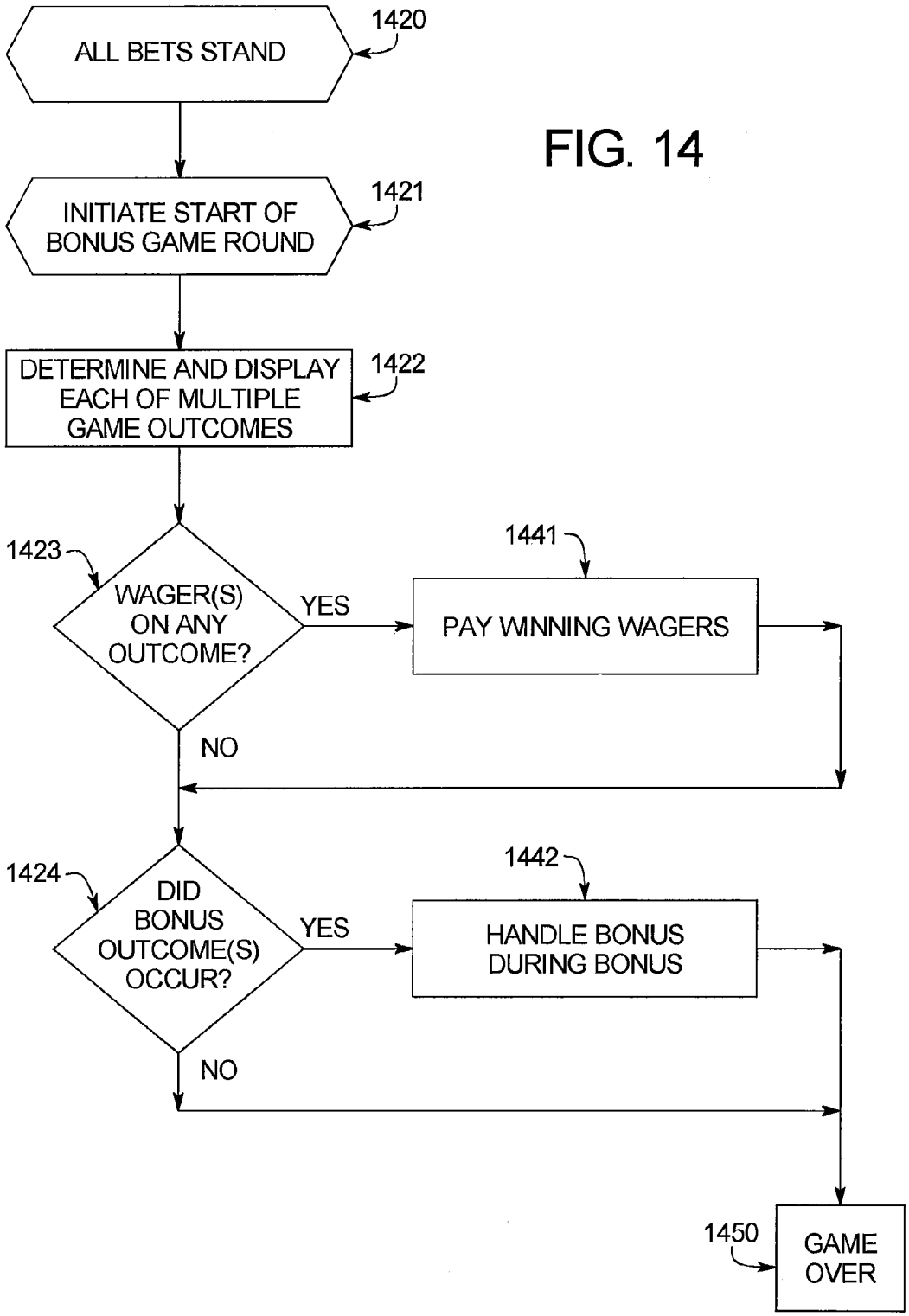
FIG. 14 is a flow diagram of bonus round with multiple parallel replays according to an embodiment of the present invention.

FIG. 14 illustrates an alternate flow chart of another bonus outcome activation. This implementation is similar to that depicted in FIG. 13, except that the multiple bonus round outcome are determined in parallel instead of sequentially. All wagers from the original game stand 1420 and the game rounds is played out 1421 where multiple outcomes are generated 1422. Optionally, these outcomes may be mutually exclusive or completely independent of each other. Each outcome is compared against wagers placed 1423, and winnings paid against such matching wagers 1441. Such rewards may optionally be paid at standard rates or at special bonus round rates according to predefined game definition. If the outcome is a bonus outcome, then it can be handled as discussed in FIG. 13 above.

Figure 15A:
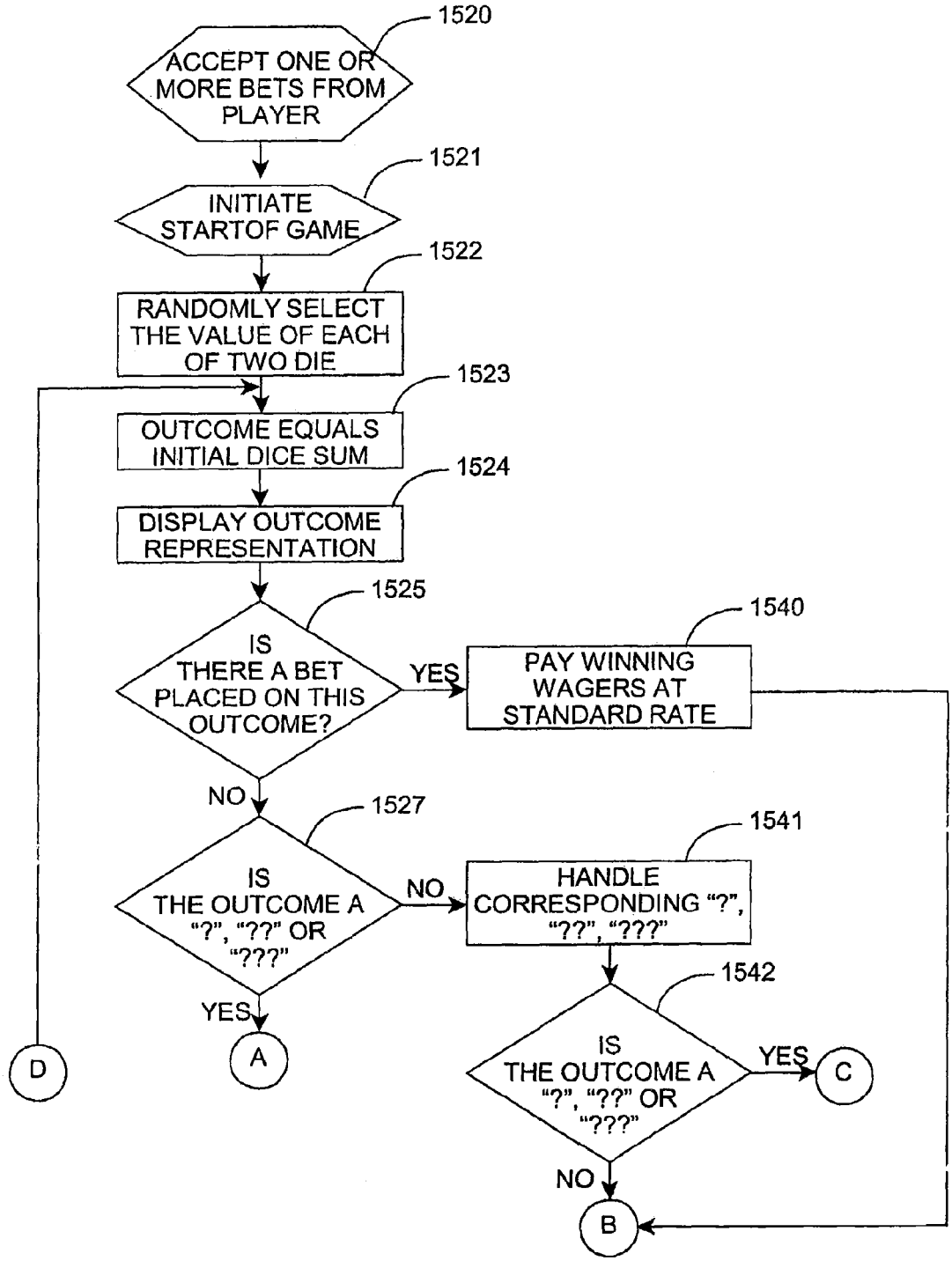
FIGS. 15A and 15B are a flow diagram of a possible dice sum game with a bonus according to an embodiment of the present invention.
Figure 15B:
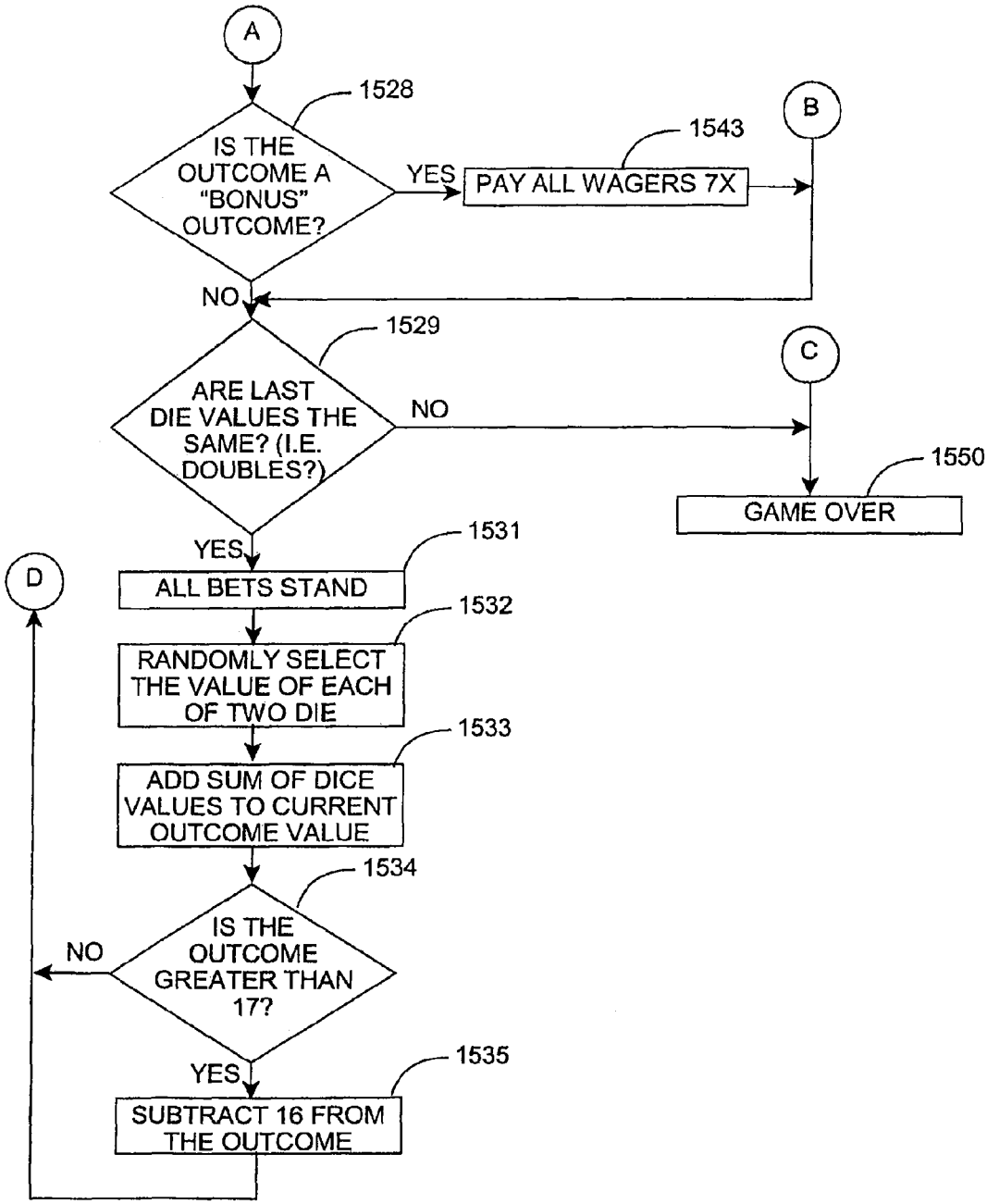

FIGS. 15A and 15B illustrates a flow chart for the optional embodiment previously shown in FIG. 8. The player places his wagers 1520 and the game commences 1521. The value for each of two dice is determined 1522 by the throw of physical dice or by the random generation of values which appear on electro-mechanical or video dice simulations. The initial outcome is determined by computing the sum of the two dice values 1523 and this outcome is then displayed 1524. When applied to a game such as that depicted in FIG. 8, the location on the game board corresponding to the generated outcome can be marked or highlighted. Any wager placed on the current outcome 1525 is rewarded in accordance with the predefined pay schedule 1540. Outcomes of "?", "??," or "???" 1527 initiate the rewarding of a bonus effect 1541. The bonus effect to be rewarded may be the earning of another thrown, the payment of a reward, the random relocation to a new outcome location, the ending of the game irrespective of whether a bonus triggering outcome were generated, or other such rewards as determined by random generation from a predetermined list of potention rewards.

If the bonus effect is to end the game 1542, then the game ends 1550, else we proceed to consider whether a bonus triggering outcome has been created. In the optional embodiment illustrated, such outcomes comprise the throwing of doubles 1529, but in alternative implementations, other outcomes-could be used. If the outcome was a "BONUS" outcome 1528 then a reward is paid, said reward being optionally computed based on all outstanding wagers 1543. Whether a bonus is paid or not, we proceed to consider whether a bonus extending outcome has been created. Optionally such an outcome is comprised of a throw of doubles. In the optional embodiment illustrated, players may not place wagers on "?", "??," "???" or "BONUS" but in an alternate embodiment such wagers may be permitted.

Once the current outcome has been evaluated, we look at whether the last dice throw was a bonus extending outcome, which in the optional embodiment illustrated consists of a throw of "doubles" 1529, i.e. whether the die values of the thrown dice are equal. If not, then the game ends 1550. Else if doubles were thrown, the player receives another throw of the dice for which all of his current wagers stand 1531, and the player will again be eligible for winnings based upon the generated outcome. As described previously 1522, two dice values are generated and summed to determine the current throw total, which total is then to the outcome sum of prior throws within the current bonus round 1533 to form the new outcome sum where such computation is performed in a modular arithmetic manner to generate a sum, modulo 16, where the sum of 0 is depicted as a value of 16, and the sum of 1 is depicted as a value of 17 1535. Once a new outcome has been determined, processing loops back to start another round of outcome evaluation 1524. In this sample game, there is no limit on how many bonus throws may occur within a single game. In an alternate implementation, such a limit may be designated.

In an optional embodiment illustrated, player bonus rewards are paid after each bonus triggering event and bonus outcome. In an alternate embodiment, player bonus rewards could be paid only at predesignated points within the bonus round, for example, after every m rolls, or only at the end of the bonus round.

While certain embodiments of the present invention have been shown and described it is to be understood that the present invention is subject to many modifications and changes without departing from the spirit and scope of the claims presented herein.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of wager areas;

(b) display a plurality of different wager area values, each one of the wager area values being associated with one of the wager areas;

(c) display a plurality of different reward ratios, each one of the reward ratios being associated with one of the wager areas;

(d) display at least one bonus area;

(e) display a bonus area value in association with the bonus area, the bonus area value being different from the wager area values;

(f) receive a wager input associated with a wager from an amount of money of a player stored on the at least one memory device;

(g) receive a selection input associated with a selection of at least one of the wager areas, the wager being applied to the at least one selected wager area;

(h) display a simulated rolling of a plurality of dice, each one of the dice having a plurality of sides, each one of the sides displaying at least one symbol, each symbol indicating a die value, at least two of the die values being different;

(i) stop the display of the simulated rolling of the dice;

(j) display a first display of one of the sides of each one of the stopped dice;

(k) calculate a first sum of the die values of the first displayed one of the sides of each one of the stopped dice;

(l) provide a game award to the player if the calculated first sum is equal to the wager area value of the at least one selected wager area;

(m) add the value of any game award provided to the player to the amount of money of the player stored on the at least one memory device;

(n) determine whether the calculated first sum is associated with a bonus event; and (o) thereafter, if the calculated first sum is associated with the bonus event:

(1) repeat (h) to (i);

(2) display a second display of one of the sides of each one of the stopped dice;

(3) calculate a second sum of the die values of the second displayed one of the sides of each one of the stopped dice;

(4) calculate a third sum based on the calculated first sum and the calculated second sum;

(5) provide a bonus award to the player based on the calculated third sum; and (6) add the value of any bonus award provided to the player to the amount of money of the player stored on the at least one memory device.

2. The gaming system of claim 1, wherein when executed by the at least one processor, the plurality of instructions cause the at least one processor to operate with the at least one display device and the at least one input device to: (a) display at least one additional bonus area; and (b) display an additional bonus area value in association with the additional bonus area, the additional bonus area value being different from the wager area values.

3. The gaming system of claim 1, wherein: (a) the wager areas include a quantity of eleven wager areas; (b) the wager area values include two, three, four, five, six, seven, eight, nine, ten, eleven, and twelve.

4. The gaming system of claim 1, wherein the bonus award is a product of a factor and the wager, the factor being greater than one.

5. The gaming system of claim 1, wherein the game award is determined based upon the reward ratio of the selected wager area.

6. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a path having a plurality of wager areas connected together to define a cycle;

(b) display a plurality of different wager area values, each one of the wager area values being associated with one of the wager areas;

(c) display a plurality of different reward ratios, each one of the reward ratios being associated with one of the wager areas;

(d) receive a wager input associated with a wager from an amount of money of a player stored on the at least one memory device;

(e) receive a selection input associated with a selection of at least one of the wager areas, the wager being applied to the at least one selected wager area;

(f) display a simulated rolling of a plurality of dice, each one of the dice having a plurality of sides, each one of the sides displaying at least one symbol, each symbol indicating a die value, at least two of the die values being different;

(g) stop the display of the simulated rolling of the dice;

(h) display a first display of one of the sides of each one of the stopped dice;

(i) calculate a first sum of the die values of the first displayed one of the sides of each one of the stopped dice;

(j) provide a game award to the player if the stopped dice satisfying a game award condition, the game award condition requiring that the calculated first sum be equal to the wager area value of the at least one selected wager area;

(k) add the value of any game award provided to the player to the amount of money of the player stored on the at least one memory device;

(l) determine whether the calculated first sum is associated with a bonus event; and (m) thereafter, if the calculated first sum is associated with the bonus event:

(i) repeat (f) to (g);

(ii) display a second display of one of the sides of each one of the stopped dice;

(iii) calculate a second sum of the die values of the second displayed one of the sides of each one of the stopped dice;

(iv) calculate a third sum based on the calculated first sum and the calculated second sum;

(v) provide a bonus award to the player based on the calculated third sum ; and (vi) add the value of any bonus award provided to the player to the amount of money of the player stored on the at least one memory device.

7. The gaming system of claim 6, wherein: (a) the wager areas include a quantity of eleven wager areas; (b) the wager area values include two, three, four, five, six, seven, eight, nine, ten, eleven, and twelve.

8. The gaming system of claim 6, wherein when executed by the at least one processor, the plurality of instructions cause the at least one processor to operate with the at least one display device and the at least one input device to determine a first position along the path, the first position being associated with the wager area which has a wager area value equal to the calculated first sum.

9. The gaming system of claim 8, wherein when executed by the at least one processor, the plurality of instructions cause the at least one processor to operate with the at least one display device and the at least one input device to determine a second position along the path, the second position being determined through advancement by a quantity of the wager areas relative to the first position, the quantity being based, at least in part, on the calculated second sum.

10. The gaming system of claim 9, wherein the path includes at least one bonus area, the bonus area displaying a bonus area value.

11. The gaming system of claim 10, wherein when executed by the at least one processor, the plurality of instructions cause the at least one processor to operate with the at least one display device and the at least one input device to provide the bonus award to the player if the second position has a same location as the bonus area.

12. The gaming system of claim 11, wherein the bonus award includes a product of a factor and the wager, the factor being greater than one.

13. The gaming system of claim 12, wherein the game award is determined based upon the reward ratio of the selected wager area.

14. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a path having a plurality of areas connected together to define a cycle, the areas including a plurality of wager areas and at least one bonus area;

(b) display a plurality of different wager area values, each one of the wager area values being associated with one of the wager areas;

(c) display a plurality of different wager area reward ratios, each one of the wager area reward ratios being associated with one of the wager areas;

(d) display a bonus value associated with the at least one bonus area;

(e) display a plurality of combination areas, the combination areas being associated different combinations of the wager areas;

(f) display a plurality of different combination reward ratios, each one of the combination reward ratios being associated with one of the combinations;

(g) receive a wager input associated with a wager from an amount of money of a player stored on the at least one memory device;

(h) receive a selection input associated with a selection of at least one area selected from the group consisting of the wager areas and the combination areas, the wager being applied to the at least one selected area;

(i) display a simulated rolling of a plurality of dice, each one of the dice having a plurality of sides, each one of the sides displaying at least one symbol, each symbol indicating a die value, at least two of the die values being different;

(j) stop the display of the simulated rolling of the dice;

(k) display a first display of one of the sides of each one of the stopped dice;

(l) calculate a first sum of the die values of the first displayed one of the sides of each one of the stopped dice;

(m) if the selected area is one of the wager areas, provide a first game award to the player if the calculated first sum is equal to the area value of said wager area; and (n) if the selected area is one of the combination areas, provide a second game award to the player if the calculated first sum is equal to one of the area values of the wager areas associated with said combination area;

(o) add the value of any game award provided to the player to the amount of money of the player stored on the at least one memory device;

(p) determine whether the calculated first sum is associated with a bonus event; and (q) thereafter, if the calculated first sum is associated with the bonus event:

(1) repeat (i) to (j);

(2) display a second display of one of the sides of each one of the stopped dice;

(3) calculate a second sum of the die values of the second displayed one of the sides of each one of the stopped dice;

(4) calculate a third sum based on the calculated first sum and the calculated second sum;

(5) provide a bonus award to the player based on the calculated third sum; and (6) add the value of any bonus award provided to the player to the amount of money of the player stored on the at least one memory device.

15. The gaming system of claim 14, wherein: (a) the wager areas include a quantity of eleven wager areas; (b) the wager area values include two, three, four, five, six, seven, eight, nine, ten, eleven, and twelve.

16. The gaming system of claim 15, wherein when executed by the at least one processor, the plurality of instructions cause the at least one processor to operate with the at least one display device and the at least one input device to determine a first position along the path, the first position being associated with the wager area which has a wager area value equal to the calculated first sum.

17. The gaming system of claim 16, wherein when executed by the at least one processor, the plurality of instructions cause the at least one processor to operate with the at least one display device and the at least one input device to determine a second position along the path, the second position being determined through advancement by a quantity of the wager areas relative to the first position, the quantity being based, at least in part, on the calculated second sum.

18. The gaming system of claim 17, wherein when executed by the at least one processor, the plurality of instructions cause the at least one processor to operate with the at least one display device and the at least one input device to provide the bonus award if the second position has a same location as the at least one bonus area.

* * * * *

UNITED STATES PATENT AND TRADEMARK OFFICE

CERTIFICATE OF CORRECTION

PATENT NO. : 7,828,294 B2
APPLICATION NO. : 12/435077
DATED : November 9, 2010
INVENTOR(S) : Nicely et al.

It is certified that error appears in the above-identified patent and that said Letters Patent is hereby corrected as shown below:

IN THE CLAIMS:

In Claim 14, Column 14, Line 62, delete “and”.

Signed and Sealed this
Eighteenth Day of January, 2011

David J. Kappos

David J. Kappos
*Director of the United States Patent and Trademark Office*